US007306889B2

(12) United States Patent
Okubo et al.

(10) Patent No.: US 7,306,889 B2
(45) Date of Patent: Dec. 11, 2007

(54) PROCESS FOR PRODUCING TONER, AND TONER

(75) Inventors: Nobuyuki Okubo, Shizuoka (JP); Tsutomu Onuma, Kanagawa (JP); Shuhei Moribe, Shizuoka (JP); Shinichiro Abe, Ibaraki (JP); Koji Nishikawa, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 468 days.

(21) Appl. No.: 11/013,535

(22) Filed: Dec. 17, 2004

(65) Prior Publication Data

US 2005/0186499 A1 Aug. 25, 2005

(30) Foreign Application Priority Data

Feb. 20, 2004 (JP) ..... 2004-043955

(51) Int. Cl.
*G03G 9/08* (2006.01)

(52) U.S. Cl. ..... 430/137.15; 430/137.18

(58) Field of Classification Search ..... 430/137.15, 430/137.18
See application file for complete search history.

(56) References Cited

U.S. PATENT DOCUMENTS

| | | | | |
|---|---|---|---|---|
| 3,941,898 | A | 3/1976 | Sadamatsu et al. | 427/18 |
| 4,301,355 | A | 11/1981 | Kimbrough et al. | 219/137 PS |
| 4,514,487 | A | 4/1985 | Kasuya et al. | 430/137 |
| 4,849,316 | A | 7/1989 | Kawaski et al. | 435/106.6 |
| 4,883,734 | A | 11/1989 | Ikeuchi et al. | 430/109 |
| 4,921,771 | A | 5/1990 | Tomono et al. | 430/110 |
| 4,988,598 | A | 1/1991 | Tomono et al. | 430/99 |
| 4,997,739 | A | 3/1991 | Tomono et al. | 430/110 |
| 5,004,666 | A | 4/1991 | Tomono et al. | 430/110 |
| 5,023,158 | A | 6/1991 | Tomono et al. | 430/99 |
| 5,225,303 | A | 7/1993 | Tomita et al. | 430/106.6 |
| 5,262,265 | A | 11/1993 | Matsunaga et al. | 430/109 |
| 5,292,609 | A | 3/1994 | Yoshikawa et al. | 430/110 |
| 5,364,722 | A | 11/1994 | Tanikawa et al. | 430/110 |
| 5,370,958 | A | 12/1994 | Shin et al. | 430/110 |
| 5,414,052 | A * | 5/1995 | Mahabadi et al. | 430/137.15 |
| 5,466,553 | A | 11/1995 | Okutani et al. | 430/109 |
| 5,492,787 | A | 2/1996 | Matsunaga et al. | 430/109 |
| 5,605,778 | A | 2/1997 | Onuma et al. | 430/110 |
| 5,629,118 | A | 5/1997 | Tomono et al. | 430/99 |
| 5,629,123 | A | 5/1997 | Tomono et al. | 430/110 |
| 5,702,859 | A | 12/1997 | Kubota | 430/110 |
| 5,780,197 | A | 7/1998 | Kubota | 430/137 |
| 5,968,701 | A | 10/1999 | Onuma et al. | 430/110 |
| 6,194,113 | B1 | 2/2001 | Okutani | 430/109 |
| 6,497,983 | B2 | 12/2002 | Iwa et al. | 430/109.2 |
| 2002/0076637 | A1 | 6/2002 | Iwa et al. | 430/109 |

FOREIGN PATENT DOCUMENTS

| | | |
|---|---|---|
| JP | 51-23354 | 7/1976 |
| JP | 52-3304 | 1/1977 |
| JP | 52-3305 | 1/1977 |
| JP | 56-087051 | 7/1981 |
| JP | 57-052574 | 3/1982 |
| JP | 57-211157 | 12/1982 |
| JP | 58-215659 | 12/1983 |
| JP | 62-9256 | 1/1987 |
| JP | 62-100775 | 5/1987 |
| JP | 62-143060 | 6/1987 |
| JP | 62-194260 | 8/1987 |
| JP | 62-195683 | 8/1987 |
| JP | 63-214760 | 9/1988 |
| JP | 63-217362 | 9/1988 |
| JP | 63-217363 | 9/1988 |
| JP | 63-217364 | 9/1988 |
| JP | 02-168264 | 6/1990 |
| JP | 02-235069 | 9/1990 |
| JP | 03-63661 | 3/1991 |
| JP | 03-63662 | 3/1991 |
| JP | 03-63663 | 3/1991 |
| JP | 3-118552 | 5/1991 |
| JP | 03-185458 | 8/1991 |
| JP | 04-124676 | 4/1992 |
| JP | 04-299357 | 10/1992 |
| JP | 04-358159 | 12/1992 |
| JP | 04-362953 | 12/1992 |
| JP | 05-173363 | 7/1993 |
| JP | 05-197192 | 8/1993 |

(Continued)

*Primary Examiner*—Christopher RoDee
(74) *Attorney, Agent, or Firm*—Fitzpatrick, Cella, Harper & Scinto

(57) ABSTRACT

A process for producing a toner by subjecting a polymer and a resin component containing a cross-linkable polymer capable of cross-linkingly reacting with the polymer, to cross-linking reaction in the presence of a first wax to form a wax-containing cross-linked polymer composition; mixing the wax-containing cross-linked polymer composition with at least a colorant and a second wax, followed by melt-kneading to form a toner composition; and pulverizing the toner composition to produce toner particles. Also disclosed is a toner produced by this process. The toner thus obtained is a toner whose fixing performance and anti-offset properties are well balanced and also which makes it possible to afford images having less fog and high quality, over a long period of time in environments of from low temperature and low humidity to high temperature and high humidity, and is highly durable without causing any contamination of members with which the toner comes into contact.

5 Claims, No Drawings

FOREIGN PATENT DOCUMENTS

| | | |
|---|---|---|
| JP | 05-241371 | 9/1993 |
| JP | 06-11890 | 1/1994 |
| JP | 06-67454 | 3/1994 |
| JP | 06-222612 | 8/1994 |
| JP | 07-20654 | 1/1995 |
| JP | 07-225491 | 8/1995 |
| JP | 08-44107 | 2/1996 |
| JP | 08-278657 | 10/1996 |
| JP | 08-289663 | 10/1996 |
| JP | 08-334919 | 12/1996 |
| JP | 08-334920 | 12/1996 |
| JP | 09-185182 | 7/1997 |
| JP | 09-244295 | 9/1997 |
| JP | 09-281748 | 10/1997 |
| JP | 09-319410 | 12/1997 |
| JP | 10-39543 | 2/1998 |
| JP | 10-87837 | 4/1998 |
| JP | 10-90943 | 4/1998 |
| JP | 10-123753 | 5/1998 |
| JP | 11-24307 | 1/1999 |
| JP | 11-43535 | 2/1999 |
| JP | 11-158336 | 6/1999 |
| JP | 11-160911 | 6/1999 |
| JP | 11-282198 | 10/1999 |
| JP | 2001-188383 | 7/2001 |
| JP | 2002-148864 | 5/2002 |
| JP | 2002-189316 | 7/2002 |

* cited by examiner

PROCESS FOR PRODUCING TONER, AND TONER

BACKGROUND OF THE INVENTION

1. Field of the Invention

This invention relates to a toner used in recording processes such as electrophotography, electrostatic recording, electrostatic printing, toner jet recording and so forth, and a process for producing the toner.

2. Related Background Art

Image forming apparatus making use of electrophotographic techniques, such as copying machines and laser beam printers, have become functionally rich in variety, where toner images to be obtained are required to be formed in a higher minuteness and a higher image quality, and toners suited therefor are used.

For example, Japanese Patent Publication No. S51-23354 discloses a toner composed of a vinyl polymer having appropriately been cross-linked by the addition of a cross-linking agent and a molecular weight modifier, and further a large number of toners are proposed which are of a blend type in which, in the vinyl polymer, Tg, molecular weight and gel content are specified in combination.

Such a toner having a cross-linked vinyl polymer or a gel content exhibits a superior effect in respect of anti-offset properties. However, in incorporating these, where this cross-linked vinyl polymer is used as a toner raw material, the internal friction in the polymer is very large in the step of melt kneading when the toner is produced, so that a large shear force is applied to the polymer. This causes cut of molecular chains in many cases to cause a decrease in melt viscosity and may adversely affect the anti-offset properties.

Japanese Patent Application Laid-open Nos. S63-214760, S63-217362, S63-217363 and S63-217364 disclose that a polymer has molecular weight distribution divided into two groups, low-molecular weight and high-molecular weight, and a carboxyl group contained in the low-molecular weight side is allowed to react with a polyvalent metal ion to effect cross-linking (a dispersion of a metal compound is added to a solution obtained by solution polymerization, followed by heating to carry out reaction).

Japanese Patent Application Laid-open Nos. H02-168264, H02-235069, H05-173363, H05-173366 and H05-241371 also disclose toner binder compositions, and toners, in which the molecular weights, mixing ratio, and acid values and ratio thereof, of a low-molecular weight component and a high-molecular weight component in a binder resin are controlled to improve fixing performance and anti-offset properties.

Japanese Patent Application Laid-open No. S62-9256 also disclose a toner binder composition in which two kinds of vinyl polymers having different molecular weights and resin acid values are blended.

Japanese Patent Application Laid-open Nos. H03-63661, H03-63662, H03-63663 and H03-118552 disclose that a vinyl copolymer containing a carboxyl group and a vinyl copolymer containing an epoxy group are allowed to react with a metal compound to effect cross-linking.

Japanese Patent Application Laid-open Nos. H07-225491 and H08-44107 also disclose that a carboxyl group-containing resin and an epoxy resin react to form a cross-linked structure.

Japanese Patent Application Laid-open Nos. S62-194260, H06-11890, H06-222612, H07-20654, H08-44107, H09-185182, H09-244295, H09-319410, H10-87837, H10-90943, H11-43535, H11-282198, 2001-188383, 2002-148864 and 2002-189316 also disclose toner binder compositions, and toners, in which a glycidyl group-containing resin is used as a cross-linking agent, and, in a resin composition constituted of a carboxyl group-containing resin, the molecular weight distribution, viscoelasticity, gel content, acid value, epoxy value and so forth are controlled to improve fixing performance and anti-offset properties.

For these proposals having been mentioned as above, it is true that good effects are obtained in respect of the improvement in anti-offset properties, but compatibility with other components constituting the toner tends to be poor. Hence, under severe conditions at the time of high-speed printing or after long-term running, the toner may have a broad charge distribution to cause problems on image quality.

In order to prevent toners from offset, it is known to incorporate toner particles with a wax as a release agent. For example, Japanese Patent Application Laid-open Nos. S52-3304, S52-3305 and S57-52574 disclose techniques therefor.

Waxes disclosed in these are used in order to improve anti-offset properties of toners at the time of low temperature or at the time of high temperature. The waxes bring an improvement in such performance on the one hand, but on the other hand may make toners have poor anti-blocking properties or have poor developing performance.

As toners which contain two or more kinds of waxes in order to more bring out over the range of from low temperature to high temperature the effect to be brought by the addition of waxes, for example, Japanese Patent Publication No. S52-3305 and Japanese Patent Application Laid-open Nos. S58-215659, S62-100775, H04-124676, H04-299357, H04-362953 and H05-197192 disclose techniques therefor.

However, in these toners as well, none of them can satisfy every performance, and they have caused some problems. For example, toners have good high-temperature anti-offset properties and good developing performance, but are not fully satisfied with low-temperature anti-offset properties; toners have good low-temperature anti-offset properties and low-temperature fixing performance, but have a little poor anti-blocking properties and have a low developing performance; toners can not have both anti-offset properties at the time of low temperature and those at the time of high temperature simultaneously; and toners cause blotches because of toner particle coat non-uniformity due to a liberated wax component to cause image defects or cause fog on images. Also, the liberated wax may contaminate developer carrying members to bring about difficulties in development.

As also disclosed in Japanese Patent Application Laid-open Nos. H08-278657, H08-334919, H08-334920 and so forth, it is proposed to incorporate toner particles with two kinds of wax components in order to obtain toners having good low-temperature fixing performance and anti-offset properties.

In these toners making use of release agents, the temperature range where both the low-temperature fixing performance and the high-temperature anti-offset properties are achievable can be enlarged. However, it is difficult to make each wax component dispersed uniformly in toner particles, and any faulty dispersion (of wax in toner particles) may make fog occur greatly, may make developing performance poor and may cause image difficulties due to contamination of developer carrying members.

As a means for improving the dispersion of the release agent, as disclosed in Japanese Patent Application Laid-open Nos. S62-195683, H03-185458, H06-67454 and so forth, methods are proposed in which a wax component is mixed, dissolved or dispersed in a solution of a polymer.

The methods disclosed in these, however, are still insufficient, and any faulty dispersion may make fog occur greatly and may make developing performance poor.

As a further means for improving the dispersion of the release agent, as disclosed in Japanese Patent Application Laid-open Nos. S56-87051, S57-211157, S62-143060, H09-281748, H10-123753, H11-158336, H11-160911 and so forth, it is proposed that polymerization for making up a resin composition is carried out in the presence of a release agent. As also disclosed in Japanese Patent Application Laid-open No. H04-358159, it is proposed that a first wax is added at the time of polymerization for producing a synthetic resin and a second wax is added at the time of melt-kneading for obtaining toner particles.

However, in the methods disclosed in these, the release agent component and the resin dissolve completely in each other, or the release agent component disperses very finely in the resin. Hence, the releasability that is fundamentally required may be damaged, and a difficulty may come to be seen such that the toner having offset, called blobs, is accumulated on fixing assembly members (e.g., separating claws, thermistor members and so forth) to stain images, making it difficult to obtain satisfactory performance. Also, in the case when two kinds of waxes are used, it is difficult to disperse the both appropriately, and any faulty dispersion may make fog occur greatly and may make developing performance poor.

To the resin mentioned above which has been subjected to cross-linking, too, every kind of wax is added, and such attempts are also disclosed in Japanese Patent Application Laid-open Nos. H08-278663, H10-39543 and H11-24307.

However, all of these are insufficient in respect of the state of dispersion of waxes, which is still unsatisfactory in regard to high-grade running performance.

SUMMARY OF THE INVENTION

An object of the present invention is to provide a toner whose fixing performance and anti-offset properties are well balanced and also which makes it possible to afford images having less fog and high quality, over a long period of time in environments of from low temperature and low humidity to high temperature and high humidity, and is highly durable without causing any contamination of members with which the toner comes into contact; and a process for producing the toner.

That is, the present invention is a process for producing a toner, which comprises:

subjecting a polymer and a resin component containing a cross-linkable polymer capable of cross-linkingly reacting with the polymer, to cross-linking reaction in the presence of a first wax to form a wax-containing cross-linked polymer composition;

mixing the wax-containing cross-linked polymer composition with at least a colorant and a second wax, followed by melt-kneading to form a toner composition; and pulverizing the toner composition to produce toner particles.

The present invention may also be the above process for producing a toner, which is characterized in that the melting point T1 (° C.) of the first wax and the melting point T2 (° C.) of the second wax as measured with a differential scanning calorimeter (DSC) satisfy the following expression:

$$10 \leqq |T1 - T2| \leqq 50.$$

The present invention may still also be the above process for producing a toner, which is characterized in that at least one of the first wax and the second wax has a polar group.

The present invention may further be the above process for producing a toner, which is characterized in that the wax-containing cross-linked polymer composition contains a vinyl resin which contains in the molecule a partial structure represented by the following formula (A):

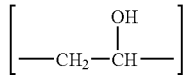

(A)

The present invention may still further be the above process for producing a toner, which is characterized in that the partial structure represented by the above formula (A) is formed during the cross-linking reaction of the polymer with the cross-linkable polymer.

The present invention may still further be the above process for producing a toner, which is characterized in that the polymer is a vinyl resin having a carboxyl group, the cross-linkable polymer is a vinyl resin having an epoxy group, and the cross-linking reaction takes place between the carboxyl group and the epoxy group.

The present invention may still further be a toner which comprises toner particles obtained by subjecting a polymer and a resin component containing a cross-linkable polymer capable of cross-linkingly reacting with the polymer, to cross-linking reaction in the presence of a first wax to form wax-containing cross-linked polymer composition, mixing the wax-containing cross-linked polymer composition with at least a colorant and a second wax, followed by melt-kneading to form a toner composition, and pulverizing the toner composition to produce toner particles.

DETAILED DESCRIPTION OF THE PREFERRED EMBODIMENTS

The process for producing a toner, of the present invention is characterized by:

subjecting a polymer and a resin component containing a cross-linkable polymer capable of cross-linkingly reacting with the polymer, to cross-linking reaction in the presence of a first wax to form a wax-containing cross-linked polymer composition;

mixing the wax-containing cross-linked polymer composition with at least a colorant and a second wax, followed by melt-kneading to form a toner composition; and pulverizing the toner composition to produce toner particles.

The use of a toner obtained by this production process has enabled contribution to the achievement of stable electrophotographic performance and low-temperature melting of the toner, has enabled achievement of high anti-offset properties in a high-temperature region, and also has enabled high prevention or restraint of fog from occurring and print density from lowering with deterioration of developing performance.

It also has enabled prevention or restraint of the toner from melt-adhering or sticking to toner contact members such as a developer carrying member and a developing blade which is a developer layer thickness control member, and has enabled prevention of image lines and density decrease from occurring because of such melt-adhering or sticking.

More specifically, the wax is separately added in different steps before resin cross-linking and after resin cross-linking. This makes it possible to strictly control the state of dispersion of the wax in the resin in which the cross-linking component is present. Hence, the anti-offset properties and the low-temperature fixing performance can simultaneously be satisfied and also the toner can have releasability over a broad temperature range, making it possible to achieve low-temperature melting of the toner and achieve high anti-offset properties in a high-temperature region. It is also possible to prevent or restrain fog from occurring and developing performance from deteriorating both because of any non-uniform dispersion of the wax, prevent or restrain the anti-offset properties from lowering because of liberation of the wax, and prevent or restrain the releasability from lowering and the resin elasticity from lowering both because of mutual dissolution of the wax and the resin. Further, if the dispersibility of the wax has lowered or if any liberated wax has come in a large quantity, linewise toner melt adhesion or sticking due to the wax tends to occur on the developer carrying member and developer layer thickness control member. This may cause lines in images or cause density decrease at the part corresponding to the portion of melt adhesion. It is possible to prevent such phenomena from appearing even during high (long-term) running.

The process for producing the toner in the present invention is described below.

First, a monomer which is a component constituting a resin polymer is polymerized to form a polymer in a desired molecular weight (Step A). Here, in order to achieve wide-range fixing performance and anti-offset properties, it is preferable to synthesize several polymers.

Further, in the case when several polymers are used together, it is preferable to mix these polymers in a solution (Step B). Mixing them in a solution makes it possible to obtain a homogeneously mixed state, and components having different molecular weights can behave in complete harmony. For example, where a high-molecular weight polymer and a low-molecular weight polymer are used in combination, the molecular weights in their respective regions can highly be controlled. This is preferable because broad ranges can be secured in fixing performance and anti-offset properties and also it is easy to achieve uniformity in chargeability as well, and because faulty images such as fog can not easily occur.

Subsequently, a resin blend obtained through Step B and the resin component containing a cross-linkable polymer capable of cross-linking reaction are mixed to make the cross-linking reaction take place to obtain a cross-linked polymer composition. As a method for making the cross-linking reaction take place, it is preferable to mix the resin blend and the resin component containing a cross-linkable polymer, followed by melt-kneading (Step C).

In the state where the resin has not been cross-linked (i.e., before completion of Step C), the resin is in the state where its molecular chains have mild intermolecular mutual action each other but other components such as wax tend to be incorporated into the molecular chains. Hence, where the wax is dividedly added in any one of Steps A to C or in a plurality of steps among Steps A, B and C, the wax is incorporated before the cross-linking reaction takes place or while the cross-linking reaction is taking place, and hence the wax comes to stand incorporated into the network of molecular chains that is formed by cross-linking. This makes it possible to effectively prevent the wax from being liberated during pulverization when toner particles are produced. That is, it is important that the cross-linking reaction between the polymer and the cross-linkable polymer is carried out in the presence of a wax (first wax).

Adding the wax at the time of melt blending (Step B) is most preferable in view of an advantage that a good state of dispersion can stably be obtained.

Where the wax is added at the time of polymerization reaction (Step A), the state of dispersion of the wax can be brought into a finely dispersed state, but the resin component and the wax component may cause reaction such as grafting to come into a mutually dissolved state, so that the releasability may come inferior to the case in which the wax is added at the time of melt blending (Step B).

The wax may also be added at the time of cross-linking reaction (Step C). However, the state of dispersion of the wax may become different depending on how the cross-linking reaction proceeds, and it may become difficult to make control.

In the present invention, the wax-containing cross-linked polymer composition obtained through Step C, a wax (second wax) and a colorant, and further optionally other toner materials such as a charge control agent, are mixed and thereafter the mixture obtained is melt-kneaded (Step D), followed by pulverization. Thereafter, the pulverized product optionally goes through toner making-up steps such as classification and addition of external additives. Thus, the toner is obtained.

The addition of the wax at the time of melt kneading of toner materials in Step D may involve a small action to finely disperse the wax in toner particles, but makes it easy for the wax to be dispersed on the outside of the molecular network of cross-linked structure. Hence, in the course of action to fix the toner, the wax may quickly melt out of toner particles when the toner is heated to melt, and may effectively readily act to make the whole toner plastic.

The wax used in the present invention may include the following. It may include, e.g., aliphatic hydrocarbon waxes such as low-molecular weight polyethylene, low-molecular weight polypropylene, polyolefin copolymer, polyolefin wax, paraffin wax, microcrystalline wax and Fischer-Tropsh wax; oxides of aliphatic hydrocarbon waxes, such as polyethylene oxide wax; or block copolymers of these; vegetable waxes such as candelilla wax, carnauba wax, japan wax (haze wax), rice wax and jojoba wax; animal waxes such as bees wax, lanolin and spermaceti; mineral waxes such as ozokelite, serecin and petrolatum; waxes composed chiefly of a fatty acid ester, such as montanate wax and castor wax; and those obtained by subjecting part or the whole of a fatty acid ester to deoxydation, such as deoxidized carnauba wax. It may further include saturated straight-chain fatty acids such as palmitic acid, stearic acid, montanic acid and also long-chain alkylcarboxylic acids having a long-chain alkyl group; unsaturated fatty acids such as brassidic acid, eleostearic acid and parinaric acid; saturated alcohols such as stearyl alcohol, eicosyl alcohol, behenyl alcohol, carnaubyl alcohol, ceryl alcohol, melissyl alcohol and also long-chain alkyl alcohols having a long-chain alkyl group; polyhydric alcohols such as sorbitol; fatty acid amides such as linolic acid amide, oleic acid amide and lauric acid amide; saturated fatty acid bisamides such as methylenebis(stearic acid amide), ethylenebis(capric acid amide), ethylenebis(lauric acid amide) and hexamethylenebis(stearic acid amide); unsaturated fatty acid amides such as ethylenebis(oleic acid amide), hexamethylenebis(oleic acid amide), N,N'-dioleyladipic acid amide and N,N'-dioleylsebasic acid amide; aromatic bisamides such as m-xylenebisstearic acid amide and N,N'-distearylisophthalic acid amide; fatty acid metal salts (those commonly called metal soap) such as calcium stearate, calcium laurate, zinc stearate and magnesium stearate; grafted waxes obtained by grafting vinyl monomers such as styrene and acrylic acid to fatty acid hydrocarbon waxes; partially esterified products of polyhydric alcohols with fatty acids, such as monoglyceride behenate; and methyl esterified products having a hydroxyl group, obtained by hydrogenation of vegetable fats and oils.

As waxes preferably usable in the present invention, hydrocarbon waxes are preferably used taking account of their dispersibility in toner particles and their influence on the chargeability of the toner. For example, such waxes may include paraffin wax, Fischer-Tropsh wax, low-molecular weight polyolefins obtained by polymerizing olefins by radical polymerization under high pressure, or by polymerization under low pressure in the presence of a Ziegler catalyst or a metallocene catalyst, polyolefins obtained by thermal degradation of high-molecular weight polyolefins, and Fischer-Tropsh waxes such as synthetic hydrocarbon waxes obtained from, or by hydrogenation of, distillation residues of hydrocarbons obtained by the Arge process from synthetic gases composed of carbon monoxide and hydrogen. An antioxidant may also previously be added. Further, preferably usable are hydrocarbon waxes having been fractionated by utilizing press sweating, solvent fractionation or vacuum distillation or by a fractionation crystallization method.

The hydrocarbons, serving as a matrix, may include those synthesized by reacting carbon monoxide with hydrogen (which may be made from either of coal and natural gas) in the presence of a metal oxide type catalyst (preferably catalysts of a two or more multiple metal oxide system), as exemplified by hydrocarbons having about several hundred carbon atoms, obtained by the Synthol process, the Hydrocol process (making use of a fluidized catalyst bed) or the Arge process (making use of a fixed catalyst bed) which can obtain waxy hydrocarbons in a large quantity; and hydrocarbons obtained by polymerization of an olefin such as ethylene in the presence of a Ziegler catalyst or a metallocene catalyst; all of which are preferable as having less branches and being saturated long straight chain hydrocarbons.

Among the waxes used in the toner of the present invention, the wax (first wax) added chiefly in Steps A to C and the wax (second wax) added chiefly in Step D may be the same one or different ones, provided that it is more preferable for them to have characteristic features shown below. Incidentally, in Steps A to C, other wax(es) may be added in an amount smaller than the first wax, and also the first wax may supplementarily be added in Step D.

The first wax may preferably be a hydrocarbon wax taking account of its dispersibility in toner particles and its influence on the chargeability of the toner. In particilar, a polyolefin wax, and especially polyethylene wax, polypropylene wax, ethylene-propylene copolymer wax, paraffin wax or Fischer-Tropsh wax is preferred.

The first wax may further preferably have a number-average molecular weight (Mn) as measured by GPC (gel permeation chromatography), of from 100 to 3,000, and more preferably from 300 to 2,000, in terms of polyethylene. If it has an Mn of less than 100, it may have its release effect with difficulty, and it tends to contaminate toner contact members. If on the other hand it has an Mn of more than 3,000, it may adversely affect fixing performance of the toner, undesirably.

The first wax may preferably further have, in a DSC curve as measured with a differential scanning calorimeter and at the time of heating, a maximum endothermic peak temperature T1 in the range of from 90° C. to 150° C., more preferably from 90° C. to 120° C., and still more preferably from 95° C. to 115° C.

If the first wax has a maximum endothermic peak temperature T1 of less than 90° C., the releasability at the time of high temperature may be attained with difficulty. If on the other hand it has a T1 of more than 150° C., it may inhibit fixing performance of the toner.

The second wax may preferably be a hydrocarbon wax modified with a polar group, such as acid modified, alcohol modified or amide modified hydrocarbon wax. Such a wax has so great a mutual action with the binder resin component as to be dispersible relatively with ease, and hence can well be dispersed in toner particles. It is also greatly effective for improving low-temperature fixing performance because of its great effect of plasticizing the binder resin component.

In particular, an alcohol modified one is preferred in view of mutual action with the resin. Such an alcohol modified hydrocarbon wax may preferably have a hydroxyl value (Hv) of from 5 to 150 mg·KOH/g, more preferably from 10 to 100 mg·KOH/g, and particularly preferably from 20 to 90 mg·KOH/g. If the wax has a hydroxyl value of less than 5 mg·KOH/g, the wax may poorly be dispersed to obtain the plasticization effect with difficulty, so that the toner may have low fixing performance and anti-offset properties and the effect on dispersibility stated above may be obtained with difficulty. If on the other hand the wax has a hydroxyl value of more than 150 mg·KOH/g, the wax may come dissolved in the resin, where the plasticizing effect may be obtained, but no release effect may be obtained, and further the wax may cause a lowering of running performance of the toner.

The second wax may also preferably have an acid value in order to further improve low-temperature fixing performance and wax dispersibility. It may preferably have an acid value of from 1 to 30 mg·KOH/g, more preferably from 1 to 15 mg·KOH/g, and still more preferably from 1 to 10 mg·KOH/g. Inasmuch as the second wax has an acid value, it can have a large interfacial adhesion to other components constituting the toner, and makes it easy to obtain the effect the second wax plasticizes the toner, so that the toner can be improved in fixing performance. If the second wax has an acid value of less than 1 mg·KOH/g, it may have a small interfacial adhesion to other components constituting the toner, and the second wax tends to come liberated, so that the action of the second wax may insufficiently be obtained. If the second wax has an acid value of more than 30 mg·KOH/g, it may conversely have too large interfacial adhesion to other components, and the plasticization of the toner may greatly proceed, so that any sufficient releasability may no longer be maintained.

The alcohol modified hydrocarbon wax may be produced by, e.g., subjecting an aliphatic hydrocarbon wax to liquid-phase oxidation with a molecular oxygen-containing gas in the presence of boric acid and boric anhydride. As a catalyst, a mixture of boric acid and boric anhydride may be used. The boric acid and the boric anhydride may be in a mixing ratio (boric acid/boric anhydride) ranging from 1.0 to 2.0, and preferably from 1.2 to 1.7, in molar ratio. If the boric anhydride is in a proportion of less than the above range, any excess boric acid may cause cohesive reduction, undesirably. If on the other hand the boric anhydride is in a proportion of more than the above range, a powdery substance derived from the boric anhydride after the reaction is collected and also any excess boric anhydride does not participate in the reaction. This is undesirable from an economical viewpoint as well.

The boric acid and boric anhydride to be used may preferably be added in an amount of from 0.001 to 10 mols, and particularly from 0.1 to 1.0 mol, based on 1 mol of the raw-material aliphatic hydrocarbon, in terms of boric acid to which the mixture of these is converted.

As the molecular oxygen-containing gas to be blown into the reaction system, usable are a wide range of gases such as oxygen and air, or those obtained by diluting them with an inert gas, and preferably those having an oxygen concentration of from 1 to 30% by volume, and more preferably from 3 to 20% by volume.

The liquid-phase oxidation reaction usually makes use of no solvent, and is carried out in the molten state of the raw-material aliphatic hydrocarbon. Reaction temperature may be from 120° C. to 280° C., and preferably from 150° C. to 250° C. Reaction time may preferably be from 1 hour to 15 hours.

It is preferable that the boric acid and the boric anhydride are previously mixed and the mixture obtained is added to the reaction system. Adding only the boric acid alone is undesirable because the dehydration reaction or the like of the boric acid may take place. Also, the mixture of boric acid and boric anhydride may be added at a temperature of from 100° C. to 180° C., and preferably from 110° C. to 160° C. Its addition at less than 100° C. is undesirable because the boric anhydride may have a low catalytic function as being caused by water content and so forth remaining in the system.

After the reaction is completed, water is added to the reaction mixture to hydrolyze the boric ester of wax that has been formed, followed by purification to obtain the desired wax.

The second wax may also preferably have a number-average molecular weight (Mn) as measured by GPC, of from 100 to 1,000 in terms of polyethylene. If it has an Mn of less than 100, it may be dispersed in toner particles with difficulty. If on the other hand it has an Mn of more than 1,000, it may have less effect of improving fixing performance of the toner, undesirably.

The second wax may preferably further have, in a DSC curve as measured with a differential scanning calorimeter and at the time of heating, a maximum endothermic peak temperature T2 in the range of from 60° C. to 95° C., more preferably from 60° C. to 90° C., and still more preferably from 70° C. to 85° C.

If the second wax has a maximum endothermic peak temperature T2 of less than 60° C., it may adversely affect storage stability, and may tend to cause toner melt adhesion to toner contact members, in particular, the part the toner comes into contact with a blade at which the temperature tends to rise. If on the other hand it has a T2 of more than 95° C., it may have less effect of improving fixing performance of the toner.

In order to obtain the effect to be brought by adding the waxes in different steps in the present invention, it is further preferable that the melting point T1 (° C.) of the first wax and the melting point T2 (° C.) of the second wax as measured with a differential scanning calorimeter (DSC) satisfy the relationship of the following expression (1):

$$10 \leqq |T1-T2| \leqq 50 \quad (1);$$

more preferably satisfy the following expression (2):

$$10 \leqq T1-T2 \leqq 50 \quad (2); \text{ and}$$

still more preferably satisfy the following expression (3):

$$15 \leqq T1-T2 \leqq 35 \quad (3).$$

Since the first wax is introduced at a previous step, it follows that steps for dispersing waxes are taken in a larger number. This enables effective dispersion of even high-melting waxes, which may be effective for anti-offset performance but may be dispersed relatively with difficulty, so that a stable charging performance can be achieved. On the contrary, the second wax added in Step D (melt-kneading step) does not undergo any reaction or heat history such as polymerization or solvent removal after it has been added. Hence, this enables addition of even low-melting waxes, which are effective for improving fixing performance of the toner. If these first and second waxes have a difference of less than 10° C. in their melting points, the effects brought respectively by the waxes added in the respective steps may be obtained with difficulty. If on the other hand this difference is more than 50° C., the respective waxes tend to behave separately from each other to tend to cause liberation or faulty dispersion of the waxes.

Measurement of Acid Value of Wax

Implements and Tools:
Erlenmeyer flask (300 ml).
Buret (25 ml).
Water bath or hot plate.
Reagents:
0.1 kmol/m$^3$ Hydrochloric acid.
0.1 kmol/m$^3$ Potassium hydroxide ethanol solution.

To make standardization, 25 ml of the 0.1 kmol/m$^3$ hydrochloric acid is taken in the Erlenmeyer flask by using a transfer pipet, and a phenolphthalein solution is added to carry out titration with the 0.1 kmol/m$^3$ potassium hydroxide ethanol solution. The factor is determined from the amount required for neutralization.

Phenolphthalein Solution Solvent.

A mixed solvent of diethyl ether and ethanol (99.5) in volume ratio of 1:1 or 2:1. This is neutralized with the 0.1 kmol/m$^3$ potassium hydroxide ethanol solution, adding a few drops of a phenolphthalein solution as an indicator immediately before use.

Measuring Method:

(a) From 1 to 20 g of the wax is precisely weighed in the Erlenmeyer flask.

(b) 100 ml of the solvent and a few drops of the phenolphthalein solution as an indicator are added, and these are thoroughly mixed by shaking until the wax dissolves completely on the water bath.

(c) Titration is carried out using the 0.1 kmol/m$^3$ potassium hydroxide ethanol solution, and the point of time where pale deep red of the indicator has continued for 30 seconds is regarded as the end point.

Calculation:

The acid value of the wax is calculated according to the following equation.

$$A=(5.611 \times B \times f)/S$$

where;

A is the acid value (mg·KOH/g);

B is the amount (ml) of the 0.1 kmol/m$^3$ potassium hydroxide ethanol solution used in the titration;

f is the factor of the 0.1 kmol/m$^3$ potassium hydroxide ethanol solution;

S is the weight (g) of the wax; and 5.611 is the numerical value found when the formular weight 56.11 of potassium hydroxide is multiplied by the concentration 0.1 (kmol/m$^3$) of the potassium hydroxide ethanol solution used.

Measurement of Hydroxyl Value of Wax

Implements and Tools:
Measuring flask (100 ml).
Transfer pipet (5 ml).
Flat-bottom flask (200 ml).
Glycerol bath.
Reagent:
Acetylating reagent.

25 g of acetic anhydride is taken in the 100 ml measuring flask, and pyridine is added to make up a 100 ml solution in total weight, followed by thorough shaking.

Phenolphthalein Solution.
0.5 kmol/m$^3$ Potassium hydroxide ethanol solution.
Measuring Method:

(a) From 0.5 to 6.0 g of the wax is precisely weighed in the flat-bottom flask, and 5 ml of the acetylating reagent is added thereto using the transfer pipet.

(b) A small funnel is placed at the mouth of the flask, and its bottom is immersed by about 1 cm in a temperature 95° C. to 100° C. glycerol bath and heated. In order to prevent the neck of the flask from being heated by the heat of the glycerol bath, the base of the neck of the flask is covered with a cardboard disk with a round hole made in the middle.

(c) One hour later, the flask is taken out of the glycerol bath. After it was left to cool, 1 ml of water is added through the funnel, followed by shaking to decompose the acetic anhydride.

(d) In order to further effect the decomposition completely, the flask is again heated in the glycerol bath for 10 minutes. After it was left to cool, the walls of the funnel and flask are washed with 5 ml of ethanol (95).

(e) A few drops of the phenolphthalein solution is added as an indicator, followed by titration with the 0.5 kmol/m$^3$ potassium hydroxide ethanol solution, and the point of time where pale deep red of the indicator has continued for 30 seconds is regarded as the end point.

(f) As an empty test, the procedures (a) to (e) are repeated without adding any wax.

(g) Where the sample does not readily dissolve, pyridine is added in a small quantity, or xylene or toluene is added, to dissolve the sample.

Calculation:

The hydroxyl value of the wax is calculated according to the following equation.

$$A=[\{(B-C)\times 28.05\times f\}/S]+D$$

where;

A is the hydroxyl value (mg·KOH/g);

B is the amount (ml) of the 0.5 kmol/m$^3$ potassium hydroxide ethanol solution used in the empty test;

C is the amount (ml) of the 0.5 kmol/m$^3$ potassium hydroxide ethanol solution used in the titration;

f is the factor of the 0.5 kmol/m$^3$ potassium hydroxide ethanol solution;

S is the weight (g) of the wax;

D is the acid value; and 28.05 is the numerical value found when the formular weight 56.11 of potassium hydroxide is multiplied by the concentration 0.5 (kmol/m$^3$) of the potassium hydroxide ethanol solution.

The molecular weight in the present invention is measured in the following way.

Conditions for Measurement by GPC of Wax

Instrument: GPC-150C (manufactured by Waters Co.).

Columns: GMH-HT (available from Toso Corporation), combination of two columns.

Temperature: 135° C.

Solvent: o-Dichlorobenzene (0.1% ionol-added)

Flow rate: 1.0 ml/min.

Sample: 0.4 ml of a sample of 0.15% in concentration is injected.

Molecular weight is measured under conditions shown above. Molecular weight of the sample is calculated using a molecular weight calibration curve prepared from a monodisperse polystyrene reference sample. Molecular weight of the wax is further calculated by conversion made according to a conversion expression derived from the Mark-Houwink viscosity equation.

Conditions for Measurement of Endothermic Peak Temperature (Melting Point) of Wax The endothermic peak temperature (melting point) of the wax is measured with a differential thermal analysis measuring instrument (DSC measuring instrument) DSC Q-1000 (manufactured by TA Instruments Japan Ltd.) under the following conditions.

Sample: 5 to 20 mg, preferably 10 mg.

Measuring method: The sample is put into an aluminum pan, and an empty aluminum pan is used as reference.

Temperature Curve:

Heating I (20° C.→180° C.; heating rate: 10° C./min).

Cooling I (180° C.→10° C.; cooling rate: 10° C./min).

Heating II (10° C.→180° C.; heating rate: 10° C./min).

The endothermic peak measured at Heating II is used to determine the endothermic peak temperature.

The process for producing the toner of the present invention has the step of making the polymer and the resin component having a cross-linkable polymer undergo cross-linking reaction (Step C).

The functional group that contributes to the cross-linking reaction includes a carboxyl group, an acid anhydride, a readily ester-interchangeable ester, a hydroxyl group, an amino group, an imino group, a glycidyl group, an epoxy group, an active methylene, a double bond, a cyano group, an isocyanate group and a vinyl group. Linking reaction such as ester linkage, amide linkage, imino linkage, imide linkage or carbon linkage between these functional groups is made to take place in Step C to effect the cross-linking of polymer molecular chains. Further, the functional groups may be linked to one another through a compound such as an acid, an alcohol, an amine, an epoxy, an acid anhydride, a ketone, an aldehyde, an amide, an imine, an ester, a lactone, a lactam or a nitrogen-containing heterocyclic compound to effect the cross-linking of polymer molecular chains. Still further, coordinating bonding or ionic bonding through a metal of a metal-containing compound such as a metal salt, a metal complex or an organometallic compound, and besides ester linkage, amide linkage or imino linkage through a nitrogen-containing compound, an epoxy compound, an alcohol compound or a carboxylic acid compound may also be utilized to carry out cross-linking reaction. Of these, as preferred cross-linking reaction, it is to make a polymer such as a polyester resin or a vinyl resin internally have an acid group such as a carboxyl group or an acid anhydride group, an amino group or a glycidyl group, and to allow any of these to react with a glycidyl compound, a nitrogen-containing compound, an epoxy compound, a carboxylic acid compound, an alcohol compound, or a metal of a metal salt, a metal complex or an organometallic compound.

In particular, preferably used is a method in which a resin having an acid group such as a carboxyl group is subjected to cross-linking reaction through an epoxy type reactive compound such as a glycidyl compound to effect cross-linking.

Where the cross-linking reaction has taken place between the carboxyl group and the epoxy group the epoxy type reactive compound has, it comes that the resin has in the molecule a partial structure represented by the following formula (A):

(A)

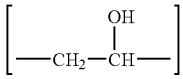

In the present invention, it is particularly preferable that the cross-linking reaction is made to take place between a vinyl resin having a carboxyl group and a vinyl resin having an epoxy group.

In the case when the cross-linking reaction is made to take place between a vinyl resin having a carboxyl group and a vinyl resin having an epoxy group, the vinyl resin having a carboxyl group may preferably have an acid value of from 1.0 to 60 mg·KOH/g, more preferably from 3 to 30 mg·KOH/g, and still more preferably from 5 to 15 mg·KOH/g. It has an acid value of less than 1.0 mg·KOH/g, the sites of cross-linking reaction between the carboxyl group and the epoxy group may come so few as to provide less cross-linked components to make it difficult to bring out running performance of the toner. In such a case, the reactivity can be compensated to a certain extent by using a vinyl resin having an epoxy group with a high epoxy value. However, any residual epoxy groups may affect developing performance, or may make it difficult to control the cross-linked structure. If the vinyl resin has an acid value of more than 60 mg·KOH/g, the toner tends to be influenced by environmental variations to tend to cause a decrease in image density and an increase in fog.

In the present invention, the acid value of the binder resin is measured according to JIS K-0070.

Measurement of Acid Value (1) From 0.1 to 0.2 g of a crushed product of a sample is precisely weighed, and the weight of the sample is represented by W (g).

(2) The sample is put into a 20 cc Erlenmeyer flask, and 10 cc of a toluene/ethanol (2:1) mixed solvent is added thereto to dissolve the sample.

(3) A few drops of an alcohol solution of phenolphthalein are added as an indicator.

(4) Using a 0.1 N KOH alcohol solution, the solution in the flask is titrated by means of a buret. The amount of the KOH solution at this point is represented by S (ml). A blank test is conducted at the same time, and the amount of the KOH solution at this point is represented by B (ml).

(5) The acid value is calculated according to the following expression.

$$\text{Acid value}=\{(S-B)\times f\times 5.61\}/W.$$

(f is the factor of KOH.)

The vinyl resin having a carboxyl group may preferably have a glass transition temperature (Tg) of from 40° C. to 70° C. If it has a Tg of less than 40° C., the toner may have low anti-blocking properties. If it has a Tg of more than 70° C., the toner tends to have a low fixing performance.

In the vinyl resin having a carboxyl group, its number-average molecular weight may preferably be from 1,000 to 40,000 in order to achieve good fixing performance and developing performance of the toner, its weight-average molecular weight may preferably be from 10,000 to 10,000,000 in order to achieve good anti-offset properties, anti-blocking properties and running performance of the toner.

The vinyl resin having a carboxyl group may preferably be constituted of a low-molecular weight component and a high-molecular weight component. The low-molecular weight component may preferably have a main-peak molecular weight of from 4,000 to 30,000 in order to achieve good fixing performance of the toner. The high-molecular weight component may preferably have a main-peak molecular weight of from 100,000 to 1,000,000 in order to achieve good anti-offset properties, anti-blocking properties and running performance of the toner.

Polymerization methods usable in the present invention as methods for synthesizing the high-molecular weight component may include balk polymerization, solution polymerization, emulsion polymerization and suspension polymerization.

Of these, the emulsion polymerization is a method in which a monomer almost insoluble in water is dispersed with an emulsifying agent in an aqueous phase in the form of small particles to carry out polymerization using a water-soluble polymerization initiator. This method enables easy control of heat of reaction, and requires only a small rate of termination reaction because the phase where the polymerization is carried out (an oily phase formed of polymers and monomers) is separate from the aqueous phase, so that a product with a high polymerization concentration and a high degree of polymerization can be obtained. Moreover, since the polymerization process is relatively simple and the polymerization product is in the form of fine particles, colorants, charge control agents and other additives can be mixed with ease when the toner is produced. Thus, this has an advantage as a production process for binder resins for toners.

However, the polymer tends to become impure because of the emulsifying agent added, and an operation such as salting-out is required to take out the polymer. In order to avoid such difficulties, solution polymerization and suspension polymerization are advantageous.

In the solution polymerization, the blending with the low-molecular weight component can be carried out in the state of solution after polymerization, without undergoing any additional step. Hence, it may preferably be used.

In order to achieve the objects of the present invention, the high-molecular weight component of the resin used in preparing a resin composition may preferably be produced using a polyfunctional polymerization initiator alone or in combination with a monofunctional polymerization initiator which are as exemplified below.

As specific examples of a polyfunctional polymerization initiator having a polyfunctional structure, it may include polyfunctional polymerization initiators having in one molecule two or more functional groups such as peroxide groups, having a polymerization initiating function, as exemplified by 1,1-di-t-butylperoxy-3,3,5-trimethylcyclohexane, 1,3-bis(t-butylperoxyisopropyl)benzene, 2,5-dimethyl-2,5-di-(t-butylperoxy)hexane, tris-(t-butylperoxy)triazine, 1,1-di-t-butylperoxycyclohexane, 2,2-di-t-butylperoxybutane, 4,4-di-t-butylperoxyvaleric acid-n-butyl ester, di-t-butyl peroxyhexahydroterephthalate, di-t-butyl peroxyazelate, di-t-butyl peroxytrimethyladipate, 2,2-bis(4,4-di-t-butylperoxycyclohexyl)propane, 2,2-di-t-butylperoxyoctane, and various polymer oxides; and polyfunctional polymerization initiators having in one molecule both a functional group such as a peroxide group, having a polymerization initiating function, and a polymerizable unsaturated group, as exemplified by diallyl peroxydicarbonate, t-butyl peroxymaleate, t-butyl peroxyallylcarbonate, and t-butyl peroxyisopropylfumarate.

Of these, more preferred ones are 1,1-di-t-butylperoxy-3,3,5-trimethylcyclohexane, 1,1-di-t-butylperoxycyclohexane, di-t-butyl peroxyhexahydroterephthalate, di-t-butyl peroxyazelate, 2,2-bis(4,4-di-t-butylperoxycyclohexyl)propane, and t-butyl peroxyallylcarbonate.

In order to satisfy various performances required as binders for toners, any of these polyfunctional polymerization initiators may preferably be used in combination with a monofunctional polymerization initiator. In particular, it may preferably be used in combination with a monofunctional polymerization initiator having a half-life of 10 hours which is lower than the decomposition temperature necessary for the polyfunctional polymerization initiator to obtain a half-life of 10 hours.

Such a monofunctional polymerization initiator may specifically include organic peroxides such as benzoylperoxide, dicumyl peroxide, t-butylperoxycumene, and di-t-butyl peroxide; and azo or diazo compounds such as azobisisobutylonitrile and diazoaminoazobenzene.

Any of these monofunctional polymerization initiators may be added in the monomer at the same time the polyfunctional polymerization initiator is added. In order to keep a proper efficiency of the polyfunctional polymerization initiator, the monofunctional polymerization initiator may preferably be added after the half-life the polyfunctional polymerization initiator shows has lapsed in the polymerization step.

Any of these polymerization initiators may preferably be used in an amount of 0.01 to 10 parts by weight based on 100 parts by weight of the monomer, in view of efficiency.

As methods for synthesizing the low-molecular-weight component, known methods may be used. In bulk polymerization, polymers with a low-molecular weight can be obtained by polymerizing the monomer at a high temperature and accelerating the rate of termination reaction. However, there is the problem of a difficulty in controlling the reaction. In this regard, in solution polymerization, low-molecular weight polymers can be obtained with ease under mild conditions, utilizing a difference in chain transfer of radicals that is caused by a solvent, and controlling the quantity of initiators and the reaction temperature. Thus, this method is preferred in order to obtain the low-molecular weight component in the vinyl resin having a carboxyl group.

As the solvent used in the solution polymerization, xylene, toluene, cumene, cellosolve acetate, isopropyl alcohol or benzene may be used. Where styrene monomers are used, xylene, toluene or cumene is preferred. The solvent may appropriately be selected depending on the polymer to be produced. As to reaction temperature, which may differ depending on the solvent and polymerization initiator to be used and the polymer to be produced by polymerization, the reaction may be carried out usually at 70° C. to 230° C. In the solution polymerization, the monomer may preferably be used in an amount of from 30 to 400 parts by weight based on 100 parts by weight of the solvent to carry out the reaction.

In the process for producing the toner of the present invention, the process may preferably have the step of blending an additional polymer in the solution when the polymerization is terminated (Step B). In Step B, the solvent used in the solution polymerization may be used as it is. Also, respective polymers may be blended by dissolving, in the solvent, polymers obtained in different polymerization methods.

The epoxy group in the vinyl resin having an epoxy group which is used in the present invention is meant to be a functional group in which an oxygen atom is united with two atom carbons in the same molecule, and has a cyclic ether structure. As a monomer having an epoxy group that constitutes the vinyl resin having an epoxy group, it may include the following.

It may include glycidyl acrylate, glycidyl methacrylate, β-methylglycidyl acrylate, β-methylglycidyl methacrylate, allyl glycidyl ether and allyl β-methylglycidyl ether. A glycidyl monomer represented by Formula (1) below may also preferably be used.

Formula (1)

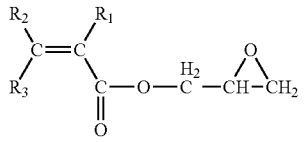

(1)

In Formula (1), $R_1$, $R_2$ and $R_3$ each represent a hydrogen atom, an alkyl group, an aryl group, an aralkyl group, a carboxyl group or an alkoxycarbonyl group.

Such a monomer having an epoxy group may be copolymerized alone, or in the form of a mixture, with a vinyl monomer by a known polymerization method to obtain the vinyl resin having an epoxy group, The vinyl resin having an epoxy group may preferably have a weight-average molecular weight (Mw) of from 2,000 to 100,000, more preferably form 2,000 to 50,000, and still more preferably from 3,000 to 40,000. If it has an Mw of less than 2,000, a large number of molecules tend to be cut in the kneading step as a result of an increase in molecular weight in virtue of the cross-linking reaction in the binder resin, resulting in a low running performance of the toner. If it has an Mw of more than 100,000, it may affect fixing performance of the toner.

The vinyl resin having an epoxy group may also preferably have an epoxy value of from 0.05 to 5.0 eq/kg. If it has an epoxy value of less than 0.05 eq/kg, the cross-linking reaction may proceed with difficulty, and the high-molecular weight component or THF-insoluble matter may be formed in a small quantity to make the toner have a low toughness. If it has an epoxy value of more than 5.0 eq/kg, the cross-linking reaction may proceed with ease but on the other hand a large number of molecules tend to be cut in the kneading step, bringing a possibility of lowering the dispersibility of the wax.

The vinyl resin having an epoxy group in the present invention may preferably be used in a mixing proportion that the epoxy group is in an equivalent weight of from 0.01 to 10.0, and more preferably in an equivalent weight of from 0.03 to 5.0, based on 1 equivalent weight of the carboxyl group in the vinyl resin having a carboxyl group.

If the epoxy group is less than 0.01 equivalent weight, the cross-linking points may be so few in the binder resin that the effect attributable to cross-linking reaction, such as running performance, may be brought out with difficulty. If on the other hand it is more than 10.0 equivalent weight, the cross-linking reaction may take place with ease but on the other hand a low dispersibility may result because of, e.g., the formation of excess THF-insoluble matter, to cause a lowering of pulverizability and a problem on the stability of development.

The epoxy value of the vinyl resin having an epoxy group is determined in the following way.

Measurement of Epoxy Value

Basic operation is made according to JIS K-7236.

(1) From 0.5 to 2.0 g of a sample is precisely weighed, and its weight is represented by W (g).

(2) The sample is put in a 300 ml beaker, and is dissolved in a mixture of 10 ml of chloroform and 20 ml of acetic acid.

(3) To the resultant solution, 10 ml of tetraethylammonium bromide acetic acid solution is added. Using an acetic acid solution of 0.1 mol/l of perchloric acid, titration is made by means of a potentiometric titrator. (For example, automatic titration may be utilized which is made using a potentiometric titrator AT-400, Win Workstation, and an ABP-410 motor buret, both manufactured by Kyoto Electronics Manufacturing Co., Ltd.). The amount of the acetic acid solution of perchloric acid used here is represented by S (ml). A blank is measured at the same time, and the amount of the acetic acid solution of perchloric acid used in this blank is represented by B (ml).

The epoxy value is calculated according to the following expression. Letter symbol f is the factor of the acetic acid solution of perchloric acid.

$$\text{Epoxy value (eq/kg)}=\{0.1\times f\times(S-B)\}/W.$$

The vinyl monomer to be copolymerized with the monomer having a carboxyl group and the monomer having an epoxy group may include the following.

Such a vinyl monomer may include, e.g., styrene; styrene derivatives such as o-methylstyrene, m-methylstyrene, p-methylstyrene, p-methoxystyrene, p-phenylstyrene, p-chlorostyrene, 3,4-dichlrostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene and p-n-dodecylstyrene; ethylene unsaturated monoolefins such as ethylene, propylene, butylene and isobutylene; unsaturated polyenes such as butadiene and isoprene; vinyl halides such as vinyl chloride, vinylidene chloride, vinyl bromide and vinyl fluoride; vinyl esters such as vinyl acetate, vinyl propionate and vinyl benzoate; α-methylene aliphatic monocarboxylic esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; acrylic esters such as methyl acrylate, ethyl acrylate, n-butyl acrylate, isobutyl acrylate, propyl acrylate, 1-octyl acrylate, dodecyl acrylate, 2-ethylhexyl acrylate, stearyl acrylate, 2-chloroethyl acrylate and phenyl acrylate; vinyl ethers such as methyl vinyl ether, ethyl vinyl ether and isobutyl vinyl ether; vinyl ketones such as methyl vinyl ketone, hexyl vinyl ketone and methyl isopropenyl ketone; N-vinyl compounds such as N-vinylpyrrole, N-vinylcarbazole, N-vinylindole and N-vinylpyrrolidone; vinylnaphthalenes; and acrylic acid or methacrylic acid derivatives such as acrylonitrile, methacrylonitrile and acrylamide. Any of these vinyl monomers may be used alone or in the form of a mixture of two or more monomers.

Of these, monomers may preferably be used in such a combination that may give a styrene copolymer and a styrene-acrylic or methacrylic copolymer. In this case, in view of fixing performance and mixing properties, such monomers may preferably contain at least 65% by weight of a styrene copolymer component or a styrene-acrylic or methacrylic copolymer component.

In regard to the use of the vinyl resin as the polymer or resin component according to the present invention, the matter has been described above, but the following resin may also be used. For example, usable are homopolymers of styrene or styrene derivatives such as polystyrene, poly-p-chlorostyrene, and polyvinyl toluene; styrene copolymers such as a styrene-p-chlorostyrene copolymer, a styrene-vinyltoluene copolymer, a styrene-vinylnaphthalene copolymer, a styrene-acrylate copolymer, a styrene-methacrylate copolymer, a styrene-methyl α-chloromethacrylate copolymer, a styrene-acrylonitrile copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer and a styrene-acrylonitrile-indene copolymer; polyvinyl chloride, phenolic resins, natural resin modified phenol resins, natural resin modified maleic acid resins, acrylic resins, methacrylic resins, polyvinyl acetate, silicone resins, polyester resins, polyurethane resins, polyamide resins, furan resins, epoxy resins, xylene resins, polyvinyl butyral, terpene resins, coumarone-indene resins, and petroleum resins. Cross-linked styrene resins may also be used.

Comonomers copolymerizable with styrene monomers in the styrene copolymers may include monocarboxylic acids having a double bond and derivatives thereof, as exemplified by acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile and acrylamide; dicarboxylic acids having a double bond and derivatives thereof, as exemplified by maleic acid, butyl maleate, methyl maleate and dimethyl maleate; vinyl esters as exemplified by vinyl chloride, vinyl acetate and vinyl benzoate; ethylenic olefins as exemplified by ethylene, propylene and butylene; vinyl ketones as exemplified by methyl vinyl ketone and hexyl vinyl ketone; and vinyl ethers as exemplified by methyl vinyl ether, ethyl vinyl ether and isobutyl vinyl ether. Any of these vinyl monomers may be used alone or in combination of two or more.

In the present invention, the wax-containing cross-linked polymer composition may preferably contain THF(tetrahydrofuran)-insoluble matter in an amount of from 1 to 30% by weight, and more preferably from 1 to 15% by weight. If the THF-insoluble matter is less than 1% by weight, the toner may have low high-temperature anti-offset properties. If it is more than 30% by weight, the toner may have low low-temperature anti-offset properties.

In the present invention, the THF-insoluble matter of the wax-containing cross-linked polymer composition is measured in the following way.

Measurement of THF-insoluble Matter

From 0.5 to 1.0 g of the wax-containing cross-linked polymer composition is weighed (W1 g), which is then put in a cylindrical filter paper (e.g., No. 86R, available from Toyo Roshi K.K.) and set on a Soxhlet extractor. Extraction is carried out for 10 hours using 200 ml of THF as a solvent, and the soluble component solution extracted by the use of the solvent is evaporated, followed by vacuum drying at 100° C. for several hours. Then the THF-soluble resin component is weighed (W2 g). Further, the weight of the insoluble matter other than the resin component such as wax is weighed, and is represented by (W3 g).

$$\text{THF-insoluble matter}=\{(W1-W2-W3)/W1-W3\}\times 100.$$

In melt-kneading the wax-containing cross-linked polymer composition, a colorant and so forth (Step D), the following polymer may besides be added to prepare the toner composition.

For example, usable are homopolymers of styrene or styrene derivatives such as polystyrene, poly-p-chlorostyrene, and polyvinyl toluene; styrene copolymers such as a styrene-p-chlorostyrene copolymer, a styrene-vinyltoluene copolymer, a styrene-vinylnaphthalene copolymer, a styrene-acrylate copolymer, a styrene-methacrylate copolymer, a styrene-methyl α-chloromethacrylate copolymer, a styrene-acrylonitrile copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer and a styrene-acrylonitrile-indene copolymer; polyvinyl chloride, phenolic resins, natural resin modified phenol resins, natural resin modified maleic acid resins, acrylic resins, methacrylic resins, polyvinyl acetate, silicone resins, polyester resins, polyurethane resins, polyamide resins, furan resins, epoxy resins, xylene resins, polyvinyl butyral, terpene resins, coumarone-indene resins, and petroleum resins. As comonomers copolymerizable with styrene monomers in the styrene copolymers, those described above may be used.

In the present invention, the molecular weight distribution (GPC) of the resin composition (polymer, resin component containing cross-linkable polymer, wax-containing cross-linked polymer composition) is measured under the following conditions.

Instrument: GPC-150C (manufactured by Waters Co.).

Columns: KF801~7 (available from Shodex Co.), combination of seven columns.

Temperature: 40° C.

Solvent: THF (tetrahydrofuran).

Flow rate: 1.0 ml/min.

Sample: 0.1 ml of a sample of from 0.05% by weight to 0.6% by weight in concentration is injected.

Measured under the above conditions. In calculating the molecular weight of the sample, a molecular weight calibration curve is used which is prepared using monodisperse polystyrene standard samples (at least ten samples of A-500, A-1000, A-2500, A-5000, F-1, F-2, F-4, F-10, F-20, F-40, F-80, F-128, F-288, F-450, F-850 and so forth are used in combination).

The toner of the present invention may preferably make use of an organometallic compound as a charge control agent. In particular, one containing the organometallic compound as a ligand or a counter ion is useful. As such a metal complex, a metal complex type monoazo compound may preferably be used from the viewpoint of charging performance. The metal complex type monoazo compound may include metal complexes of monoazo dyes, described in Japanese Patent Publication Nos. S41-20153, S42-27596, S44-6397, S45-26478 and so forth.

In particular, in view of dispersibility and charging performance, a metal complex type monoazo compound represented by the following Formula (I) is preferred, of which it is preferable to use a metal complex type monoazo iron complex whose central metal is iron. It is more preferable to use a monoazo compound represented by the following Formula (II).

Formula (I)

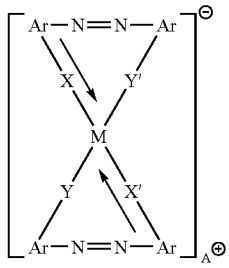

(1)

In the formula, M represents a coordination central metal, which is selected from the group consisting of Cr, Co, Ni, Mn, Fe, Ti and Al. Ar represents a phenyl group or a naphthyl group, which may have a substituent selected from the group consisting of a nitro group, a halogen atom, a carboxyl group, an anilide group, and an alkyl group having 1 to 18 carbon atoms or an alkoxyl group having 1 to 18 carbon atoms. X, X', Y and Y' are each one or more linking groups selected from the group consisting of —O—, —CO—, —NH— and —NR— (R is an alkyl group having 1 to 4 carbon atoms). A represents any of a hydrogen ion, a sodium ion, a potassium ion, an ammonium ion and an aliphatic ammonium ion, or a mixture of any of these.

Formula (II)

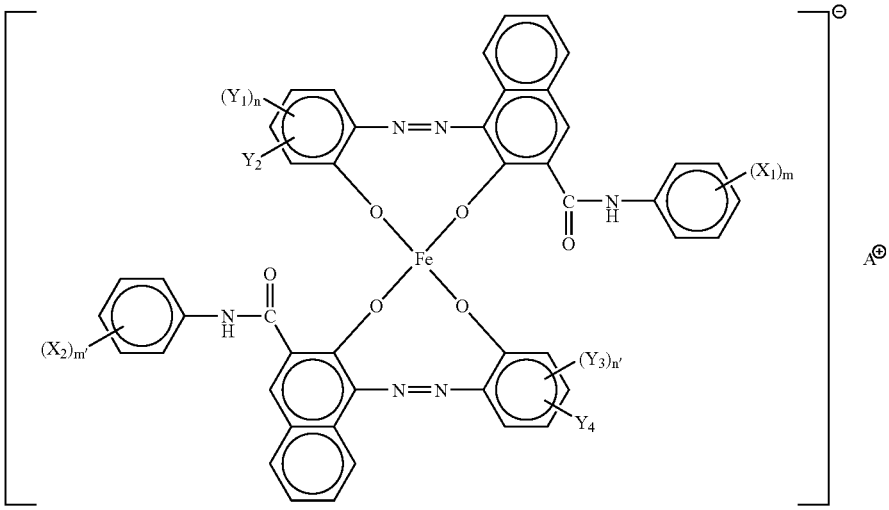

(II)

In the formula, $X_1$ and $X_2$ are each selected from the group consisting of a hydrogen atom, a lower alkyl group, a lower alkoxyl group, a nitro group and a halogen atom, and m and m' each represent an integer of 1 to 3; $Y_1$ and $Y_3$ are each selected from the group consisting of a hydrogen atom, an alkyl group having 1 to 18 carbon atoms, an alkenyl group, a sulfonamide group, a mesyl group, a sulfonic acid group, a carboxylic ester group, a hydroxyl group, an alkoxyl group having 1 to 18 carbon atoms, an acetylamino group, a benzoyl group, an amino group and a halogen atom; n and n' each represent an integer of 1 to 3; and $Y_2$ and $Y_4$ each represent a hydrogen atom or a nitro group. A represents an ammonium ion, an alkali metal ion, a hydrogen ion or a mixture of any of these.

Those preferable as agents for negative charging may include, e.g., Spilon Black TRH, T-77, T-95 (available from Hodogaya Chemical Co., Ltd.); BONTRON (registered trademark) S-34, S-44, S-54, E-84, E-88, E-89 (available from Orient Chemical Industries Ltd.). Those preferable as agents for positive charging may include, e.g., TP-302, TP-415 (available from Hodogaya Chemical Co., Ltd.); BONTRON (registered trademark) N-01, N-04, N-07, P-51 (available from Orient Chemical Industries Ltd.), Copy Blue PR (Klariant GmbH).

The metal complex type monoazo compound may preferably be contained in an amount of from 0.05 to 5 parts by weight, and particularly preferably from 0.2 to 3 parts by weight, based on 100 parts by weight of the binder resin. If the metal complex type monoazo compound is in too large a content, the toner may have a low fluidity to tend to cause fog. If on the other hand it is in too small a content, sufficient charge quantity may be obtained with difficulty.

As the colorant in the present invention, any suitable pigments and dyes may be used. Toner colorants are well known in the art. For example, the pigments include carbon black, Aniline Black, acetylene black, Naphthol Yellow, Hanza Yellow, Rhodamine Lake, Alizarine Lake, red iron oxide, Phthalocyanine Blue and Indanethrene Blue. Any of these may be used in an amount necessary for maintaining optical density of fixed images, and may be added in an amount of from 0.1 to 20 parts by weight, and preferably from 0.2 to 10 parts by weight, based on 100 parts by weight of the binder resin. For the same purpose, dyes may also be used. For example, the dyes may include azo dyes, anthraquinone dyes, xanthene dyes and methine dyes. The dye may be added in an amount of from 0.1 to 20 parts by weight, and preferably from 0.3 to 10 parts by weight, based on 100 parts by weight of the binder resin.

The toner of the present invention may preferably be used as a magnetic toner containing a magnetic material. In the case when the magnetic material is used, the magnetic material may be made to serve also as a colorant. Usable magnetic materials include metal oxides containing any of elements such as iron, cobalt, nickel, copper, magnesium, manganese, aluminum and silicon. The magnetic material may preferably have a BET specific surface area, as measured by the nitrogen absorption method, of from 1 to 20 $m^2/g$, and particularly from 2.5 to 12 $m^2/g$, and also may preferably have a Mohs hardness of from 5 to 7. As the particle shape of the magnetic material, it may be, e.g., octahedral, hexahedral, spherical, acicular or flaky. Octahedral, hexahedral or spherical ones are preferred as having less anisotropy. This is because one having an isotropic shape can achieve a good dispersibility also in respect to the binder resin and the wax as in the present invention. The magnetic material may preferably have a number-average particle diameter of from 0.05 μm to 1.0 μm, more preferably from 0.1 μm to 0.6 μm, and still more preferably from 0.1 μm to 0.4 μm.

The magnetic material may preferably be added in an amount of from 40 to 200 parts by weight, and particularly preferably from 50 to 150 parts by weight, based on 100 parts by weight of the binder resin. If it is added in an amount of less than 40 parts by weight, the toner may insufficiently be transported to cause non-uniformity in the developer layer on the developer carrying member, tending to result in image non-uniformity, and further tending to cause a decrease in image density due to an excess rise of charge of the developer. If on the other hand it is added in an amount of more than 200 parts by weight, the charge of the developer may insufficiently be attained to tend to cause a decrease in image density.

In the toner of the present invention, an inorganic fine powder or a hydrophobic inorganic fine powder may preferably be mixed in order to improve environmental stability, charging stability, developing performance, an storage stability. For example, it may include fine silica powder, fine titanium oxide powder and hydrophobic-treated products of these. Any of these may be used alone or in combination.

As the fine silica powder, usable are what is called dry-process silica or fumed silica produced by vapor phase oxidation of silicon halides and what is called wet-process silica produced from water glass or the like, either of which may be used. The dry-process silica is preferred, as having less silanol groups on the particle surfaces and interiors and leaving less production residues such as $Na_2O$ and $SO_3^{2-}$. In the dry-process silica, it is also possible to use in its production step, e.g., other metal halide such as aluminum chloride or titanium chloride together with the silicon halide to give a composite fine powder of silica with other metal oxide. The fine silica powder includes these as well.

The fine silica powder may further preferably be one having been hydrophobic-treated. For making hydrophobic, the fine silica powder may be made hydrophobic by chemical treatment with, e.g., an organosilicon compound capable of reacting with or physically adsorptive on the fine silica powder. As a preferable method, the dry-process fine silica powder produced by vapor phase oxidation of a silicon halide may be treated with an organosilicon compound such as silicone oil after it has been treated with a silane compound or at the same time it is treated with a silane compound.

The silane compound used in the hydrophobic treatment may include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilyl mercaptan, trimethylsilyl mercaptan, triorganosilyl acrylate, vinyldimethylacetoxysilane, dimethyldiethoxysilane, dimethyldimethoxysilane, diphenyldiethoxysilane, hexamethyldisiloxane, 1,3-divinyltetramethyldisiloxane and 1,3-diphenyltetramethyldisiloxane.

The organosilicon compound may include silicone oils. As preferred silicone oils, those having a viscosity at 25° C. of from 30 to 1,000 $mm^2/S$ may be used. For example, particularly preferred are dimethylsilicone oil, methylphenylsilicone oil, α-methylstyrene modified silicone oil, chlorophenylsilicone oil and fluorine modified silicone oil.

As a method for the treatment with silicone oil, a method may be employed for example in which the fine silica powder treated with a silane compound and the silicone oil are directly mixed by means of a mixing machine such as Henschel mixer, or the silicone oil is sprayed on the fine silica powder serving as a base. Besides, a method is also available in which the silicone oil is dissolved or dispersed in a suitable solvent and thereafter the fine silica powder is mixed, followed by removal of the solvent.

External additives other than the fine silica powder and the fine titanium oxide powder may also optionally be added to toner particles (toner base particles) of the toner of the present invention.

Such external additives may include, e.g., a charging auxiliary agent, a conductivity-providing agent, a fluidity-providing agent, an anti-caking agent, and fine resin particles or inorganic fine particles which act as a release agent, a lubricant or an abrasive at the time of heat-roller fixing.

For example, the lubricant may include polyfluoroethylene powder, zinc stearate powder and polyvinylidene fluoride powder; in particular, polyvinylidene fluoride powder is preferred. The abrasive may include cerium oxide powder, silicon carbide powder and strontium titanate powder; in particular, strontium titanate powder is preferred. The fluidity-providing agent may include, e.g., titanium oxide powder and aluminum oxide powder; in particular, hydrophobic one is preferred. The anti-caking agent, the conductivity-providing agent such as, e.g., carbon black powder, zinc oxide powder, antimony oxide powder and tin oxide powder, and white fine particles and black fine particles having opposite polarity may also be used as a developing performance improver in a small quantity.

The fine resin particles, inorganic fine particles or hydrophobic inorganic fine particles to be blended with toner particles (toner base particles before addition of the external additives) may be used in an amount of from 0.1 to 5 parts by weight, and preferably from 0.1 to 3 parts by weight, based on 100 parts by weight of the toner base particles.

The toner obtained by the production process of the present invention may preferably have a weight-average particle diameter (D4) of from 2.5 μm to 10.0 μm, more preferably from 5.0 μm to 9.0 μm, and still more preferably from 6.0 μm to 8.0 μm, where a sufficient effect can be brought out.

The weight-average particle diameter (D4) and particle size distribution of the toner are measured by the Coulter Counter method. For example, COULTER MULTISIZER (manufactured by Coulter Electronics, Inc.) may be used. As an electrolytic solution, an aqueous 1% NaCl solution is prepared using first-grade sodium chloride. For example, ISOTON R-II (available from Coulter Scientific Japan Co.) may be used. To make measurement, as a dispersant 0.1 to 5 ml of a surface active agent (preferably an alkylbenzenesulfonate) is added to 100 to 150 ml of the above aqueous electrolytic solution, and 2 to 20 mg of a sample for measurement is further added. The electrolytic solution in which the sample has been suspended is subjected to dispersion for about 1 minute to about 3 minutes in an ultrasonic dispersion machine. The volume distribution and number distribution of the toner are calculated by measuring the volume and number of toner particles of 2.00 μm or more in diameter by means of the above measuring instrument, using an aperture of 100 μm as its aperture. Then the weight-average particle diameter (D4) according to the present invention, determined from the volume distribution, is calculated. As channels, 13 channels are used, which are of 2.00 to less than 2.52 μm, 2.52 to less than 3.17 μm, 3.17 to less than 4.00 μm, 4.00 to less than 5.04 μm, 5.04 to less than 6.35 μm, 6.35 to less than 8.00 μm, 8.00 to less than 10.08 μm, 10.08 to less than 12.70 μm, 12.70 to less than 16.00 μm, 16.00 to less than 20.20 μm, 20.20 to less than 25.40 μm, 25.40 to less than 32.00 μm, and 32.00 to less than 40.30 μm.

The toner obtained by the production process of the present invention may be used in combination with a carrier so as to be used as a two-component developer. As the carrier used in the two-component development, a conventionally known carrier may be used. Stated specifically, usable as carrier particles are particles formed of a metal such as iron, nickel, cobalt, manganese, chromium or a rare earth element, or an alloy or oxide thereof, having been surface-oxidized or unoxidized, and having a volume-average particle diameter of from 20 μm to 300 μm.

Preferred is a carrier on the particle surfaces of which a material such as a styrene resin, an acrylic resin, a silicone resin, a fluorine resin or a polyester resin has been deposited or coated.

The toner particles (toner base particles) in the present invention may be formed by well mixing toner constituent materials by means of a mixing machine such as a ball mill, melt-kneading the resultant mixture sufficiently by means of a heat kneading machine such as a heat roll, a kneader or an extruder, and cooling the kneaded product to solidity, followed by pulverization and then strict classification.

As the mixing machine, it may include, e.g., Henschel Mixer (manufactured by Mitsui Mining & Smelting Co., Ltd.); Super Mixer (manufactured by Kawata MFG Co., Ltd.); Conical Ribbon Mixer (manufactured by Y.K. Ohkawara Seisakusho); Nauta Mixer, Turbulizer, and Cyclomix (manufactured by Hosokawa Micron Corporation); Spiral Pin Mixer (manufactured by Pacific Machinery & Engineering Co., Ltd.); and Rhedige Mixer (manufactured by Matsubo Corporation). As the kneading machine, it may include KRC Kneader (manufactured by Kurimoto, Ltd.); Buss-Kneader (manufactured by Coperion Buss Ag.); TEM-type Extruder (manufactured by Toshiba Machine Co., Ltd.); TEX Twin-screw Extruder (manufactured by The Japan Steel Works, Ltd.); PCM Kneader (manufactured by Ikegai Corp.); Three-Roll Mill, Mixing Roll Mill, and Kneader (manufactured by Inoue Manufacturing Co., Ltd.); Kneadex (manufactured by Mitsui Mining & Smelting Co., Ltd.); MS-type Pressure Kneader, and Kneader-Ruder (manufactured by Moriyama Manufacturing Co., Ltd.); and Banbury Mixer (manufactured by Kobe Steel, Ltd.).

As a grinding machine, it may include Counter Jet Mill, Micron Jet, and Inomizer (manufactured by Hosokawa Micron Corporation); IDS-type Mill, and PJM Jet Grinding Mill (manufactured by Nippon Pneumatic MFG Co., Ltd.); Cross Jet Mill (manufactured by Kurimoto, Ltd.); Ulmax (manufactured by Nisso Engineering Co., Ltd.); SK Jet O-Mill (manufactured by Seishin Enterprise Co., Ltd.); Criptron (manufactured by Kawasaki Heavy Industries, Ltd); and Turbo Mill (manufactured by Turbo Kogyo Co., Ltd.). As a classifier, it may include Classyl, Micron Classifier, and Spedic Classifier (manufactured by Seishin Enterprise Co., Ltd.); Turbo Classifier (manufactured by Nisshin Engineering Inc.); Micron Separator; Turboprex(ATP), and TSP Separator (manufactured by Hosokawa Micron Corporation); Elbow Jet (manufactured by Nittetsu Mining Co., Ltd.); Dispersion Separator (manufactured by Nippon Pneumatic MFG Co., Ltd.); and YM Microcut (manufactured by Yasukawa Shoji K.K.). As a sifter used to sieve coarse powder and so forth, it may include Ultrasonics (manufactured by Koei Sangyo Co., Ltd.); Rezona Sieve, and Gyro Sifter (manufactured by Tokuju Corporation); Vibrasonic Sifter (manufactured by Dulton Company Limited); Sonicreen (manufactured by Shinto Kogyo K.K.); Turbo-Screener (manufactured by Turbo Kogyo Co., Ltd.); Microsifter (manufactured by Makino mfg. co., ltd.); and circular vibrating screens.

EXAMPLES

The present invention is described below by giving specific working examples. The present invention is by no means limited to these.

Wax

Waxes used in these working examples are shown in Table 1 below.

TABLE 1

| Step A (Polymerization Step) High-Molecular Weight Component Production Example A-1 | (by weight) |
|---|---|
| Styrene | 76.0 parts |
| n-Butyl acrylate | 22.0 parts |
| Methacrylic acid | 2.0 parts |
| 2,2-Bis(4,4-di-t-butylperoxy-cyclohexyl)propane | 0.7 part |

In a four-necked flask, with stirring of 200 parts by weight of xylene, the inside atmosphere of the container was sufficiently displaced with nitrogen and was heated to 120° C., and thereafter the above materials were dropwise added thereto over a period of 4 hours. Further, after retention under reflux of xylene, polymerization was completed. Thus, a solution containing High-Molecular Weight Component A-1 was obtained.

High-Molecular Weight Component

Production Example A-2

180 parts by weight of deaerated water and 20 parts by weight of a 2% by weight aqueous solution of polyvinyl alcohol were introduced into a four-necked flask, and thereafter a liquid mixture of 70.0 parts by weight of styrene, 25.0 parts by weight of n-butyl acrylate, 5.0 parts by weight of monobutyl maleate and 0.1 part by weight of 2,2-bis(4,4-di-t-butylperoxycyclohexyl)propane was added thereto to prepare a suspension. The inside atmosphere of the flask was sufficiently displaced with nitrogen, and then the contents were heated to 85° C., which was kept for 24 hours, followed by filtration, washing with water and then drying to obtain High-Molecular Weight Polymer A-2.

High-Molecular Weight Component

Production Example A-3

A solution containing High-Molecular Weight Component A-3 was obtained in the same manner as in High-Molecular Weight Component Production Example A-1 except that in Production Example A-1 the formulation of monomers was changed to 78.0 parts by weight of styrene, 21.6 parts by weight of n-butyl acrylate, 0.4 part by weight of methacrylic acid and 0.8 part by weight of 2,2-bis(4,4-di-t-butylperoxycyclohexyl)propane.

Formulation and analytical values of these High-Molecular Weight Components A-1 to A-3 are shown in Table 2.

TABLE 2

| Low-Molecular Weight Component Production Example B-1 | (by weight) |
|---|---|
| Styrene | 79.1 parts |
| n-Butyl acrylate | 20.0 parts |
| Methacrylic acid | 0.9 part |
| Di-tert-butyl peroxide | 1.4 parts |

The above materials were dropwise added to 200 parts by weight of xylene over a period of 4 hours. Further, after retention under reflux of xylene, polymerization was completed. Thus, a solution containing Tow-Molecular Weight Component B-1 was obtained.

Low-Molecular Weight Component

Production Example B-2

A solution containing Low-Molecular Weight Component B-2 was obtained in the same manner as in Low-Molecular Weight Component Production Example B-1 except that in the xylene solvent in Production Example B-13.0 parts by weight of Wax W-1 was dissolved and thereafter the monomers were dropwise added.

Low-Molecular Weight Component

Production Example B-3

A solution containing Low-Molecular Weight Component B-3 was obtained in the same manner as in Low-Molecular Weight Component Production Example B-1 except that in Production Example B-1 the resin components were changed to 80.0 parts by weight of styrene, 19.5 parts by weight of n-butyl acrylate, 0.5 part by weight of methacrylic acid and 4.5 parts by weight of di-tert-butyl peroxide.

Low-Molecular Weight Component

Production Example B-4

A solution containing Low-Molecular Weight Component B-4 was obtained in the same manner as in Low-Molecular Weight Component Production Example B-1 except that in the xylene solvent in Production Example B-13.0 parts by weight of Wax W-4 and 3.0 parts by weight of Wax W-7 were dissolved and thereafter the monomers were dropwise added.

Formulation and analytical values of these Low-Molecular Weight Components are shown in Table 3.

TABLE 3

| Cross-linkable Resin Component* Production Example C-1 | (by weight) |
|---|---|
| Styrene | 79.2 parts |
| n-Butyl acrylate | 19.8 parts |
| Glycidyl methacrylate | 1.0 part |
| Di-tert-butyl peroxide | 5.0 parts |

*(Resin Component Containing Cross-linkable Polymer)

In a four-necked flask, with stirring of 200 parts by weight of xylene, the inside atmosphere of the container was sufficiently displaced with nitrogen and was heated to 120° C., and thereafter the above materials were dropwise added thereto over a period of 4 hours. Further, after retention under reflux of xylene, polymerization was completed, followed by removal of the solvent by evaporation under reduced pressure. The resin component thus obtained is designated as Cross-linkable Resin Component C-1.

Cross-Linkable Resin Component

Production Example C-2

Cross-linkable Resin Component C-2 was obtained in the same manner as in Cross-linkable Resin Component Production Example C-1 except that in Production Example C-1 the formulation of monomers was changed to 72.0 parts by weight of styrene, 18.0 parts by weight of n-butyl acrylate, 10.0 parts by weight of glycidyl methacrylate and 5.0 parts by weight of di-tert-butyl peroxide.

Formulation and analytical values of these Cross-linkable Resin Components C-1 and C-2 are shown in Table 4.

TABLE 4

| Step B (Resin Solution Blending Step) |
|---|
| The high-molecular weight components, low-molecular weight components and waxes thus obtained were mixed in the proportions shown in Table 5, based on 200 parts by weight of xylene, and dissolved. These were heated, and stirred and mixed for 12 hours under reflux. Thereafter, the organic solvent was removed, and the resins obtained were cooled to solidify, followed by pulverization to obtain Raw Resins R-1 to R-10. Incidentally, in all the raw resins, THF-insoluble matter was substantially not contained. |

TABLE 5

| Raw Resin R-11 Production Example | (by weight) |
|---|---|
| Styrene | 70.0 parts |
| n-Butyl acrylate | 24.0 parts |
| Monobutyl maleate | 6.0 parts |
| Di-tert-butyl peroxide | 1.0 part |

The above raw materials were dropwise added to 200 parts by weight of xylene over a period of 4 hours. Further, after retention under reflux of xylene, polymerization was completed. Thus, a solution containing a resin component having the following physical properties was obtained.

Main-peak molecular weight: 21,000.

Glass transition temperature (Tg): 60° C.

Acid value: 17 mg·KOH/g.

In this solution (containing 100 parts by weight of the resin component), 3 parts by weight of Wax W-1 was mixed and dissolved. This was heated, and stirred and mixed for 12 hours under reflux. Thereafter, the organic solvent was removed, and the resin obtained was cooled to solidify, followed by pulverization to obtain Raw Resin R-11. Incidentally, in this raw resin, THF-insoluble matter was substantially not contained.

Weight-average molecular weight: 210,000.

Number-average molecular weight: 8,000.

Main-peak molecular weight: 21,000.

Glass transition temperature (Tg): 60° C.

Acid value: 16.5 mg·KOH/g.

Step C (Resin Cross-Linking Step)

The above raw resins and cross-linkable resin components were put into Henschel mixer in the proportions shown in Table 6, and mixed. The mixtures obtained were each melt-mixed by means of a twin-screw extruder heated to 200° C. to allow carboxyl groups and epoxy groups to react with one another to effect cross-linking. The resins obtained were cooled to solidify, followed by pulverization to obtain Toner Binder Resins M-1 to M-12. The resins obtained were analyzed to ascertain that they contained about 10% by weight of THF-insoluble matter and the cross-linking had taken place. Also, it was simultaneously ascertained that they each had the partial structure represented by the following formula (A):

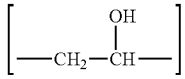

(A)

Incidentally, only in the case of Toner Binder Resin M-8, Wax W-1 was added in an amount of 3 parts by weight based on 100 parts by weight of the total of the raw resin and cross-linkable resin component. Composition and analytical values of the toner binder resins are shown in Table 6.

TABLE 6

| Step D (Toner Making-up Step) Preparation of Toner 1 | (by weight) |
|---|---|
| Toner Binder Resin M-1 | 100.0 parts |
| Spherical magnetic iron oxide (number-average particle diameter: 0.21 μm) | 95.0 parts |
| Monoazo iron complex (represented by the following formula) | 2.0 parts |
| Wax W-2 | 3.0 parts |

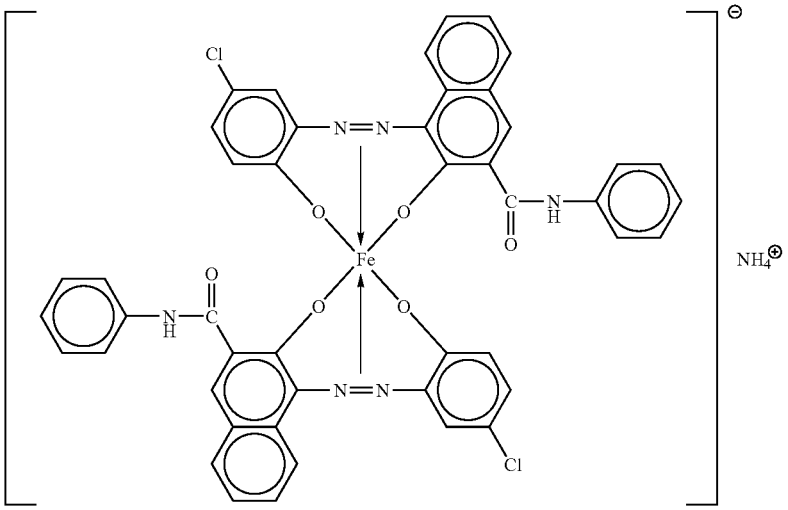

The above materials were premixed by means of Henschel mixer. Thereafter, the mixture obtained was melt-kneaded by means of a twin-screw extruder heated to 90° C. The kneaded product obtained, having been cooled, was crushed using a hammer mill to obtain a toner crushed product.

The crushed product obtained was finely pulverized by means of a jet mill. Thereafter, the pulverized product obtained was air-classified to obtain a classified product. The classified product obtained had a weight-average particle diameter (D4) as measured by the Coulter counter method, of 6.6 μm, where the cumulative value of number distribution of toner particles of less than 4 μm in diameter was 25.2%.

100.0 parts by weight of this classified product and 1.4 parts by weight of hydrophobic fine silica powder having been treated with hexamethyldisilazane and then with dimethylsilicone oil were mixed by means of Henschel mixer to prepare Toner 1.

Preparation of Toners 2 to 18

Toners 2 to 18 were prepared in the same manner as Toner 1 except that the binder resin and wax used were changed as shown in Table 7. Here, in Toner 6, two kinds of waxes W-1 (3 parts by weight) and W-2 (3 parts by weight) were added in Step D (Toner Making-up Step). Also, in Toner 18, two kinds of waxes W-4 (3 parts by weight) and W-7 (3 parts by weight) were added in Step D (Toner Making-up Step).

TABLE 7

Examples 1 to 16 &

Comparative Examples 1 and 2

Next, using the toners thus prepared, evaluation was made in the manner as shown below. The results of evaluation are shown in Tables 8-1 and 8-2.

Incidentally, the toners obtained in Examples 1 to 16 were those in which the high-melting wax (first wax) stood incorporated into the cross-linked structure and the liberation of wax from toner particles was kept restrained. Also, as shown in the following evaluation results, the toners obtained in Examples 1 to 16 were those having superior fixing performance and in which, in regard to the low-melting wax (second wax) as well, it had good dispersibility.

(1) Image Density, Fog:

In each environment of a normal-temperature and normal-humidity environment (23° C./60% RH), a low-temperature and low-humidity environment (15° C./10% RH) and a high-temperature and high-humidity environment (32.5° C./80% RH), an intermittent image reproduction test was conducted at a printing speed of 1 sheet/10 seconds, in a print percentage of 4% and on copying machine plain paper (A4 size, 75 g/m$^2$ in basis weight), using a laser beam printer LASER JET 2300, manufactured by Hewlett-Packard Co., which was altered to have a process speed of 210 mm/second. When the toner ran short, the toner was replenished until the image reproduction test was conducted on 12,000 sheets.

The image density was measured with MACBETH REFLECTION DENSITOMETER (manufactured by Macbeth Co.), as relative density with respect to an image printed on a white background area with a density of 0.00 of an original.

The fog was measured during the image reproduction test in a low-temperature and low-humidity environment (15° C./10% RH). The fog was calculated from a difference between the whiteness of a transfer sheet and the whiteness of the transfer sheet after print of solid white which were measured with a reflectometer manufactured by Tokyo Denshoku Co., Ltd.

(2) Toner Lines on Sleeve:

In the test on (1), in the high-temperature and high-humidity environment (32.5° C./80% RH), the developing sleeve was observed at intervals of 4,000 sheets to see whether or not toner lines appeared on the sleeve, to make evaluation according to the following evaluation criteria.

A: No toner line appears.

B: One or two lines are seen, but easily disappear when rubbed with paper.

C: One to five lines are seen, and do not disappear even when rubbed with paper, standing melt adhesion, but no influence is seen on images.

D: Six or more lines are seen, and melt adhesion has clearly occurred.

(3) Fixing Performance:

To evaluate fixing performance, images were reproduced using copying machine plain paper of 90 g/m$^2$ in basis weight, in a low-temperature and low-humidity environment (7.5° C./10% RH), and using a laser beam printer LASER JET 1300, manufactured by Hewlett-Packard Co., which was altered to have a process speed of 150 mm/second. Fixed images obtained immediately after start of reproduction were rubbed with soft thin paper under application of a load of 4.9 kPa, and the rate (%) of decrease in image density before and after the rubbing was measured to make evaluation according to the following evaluation criteria. Here, toner laid-on quantity on images was 5 g/m$^2$.

A: Less than 2%.

B: From 2% to less than 4%.

C: From 4% to less than 8%.

D: From 8% to less than 12%.

E: More than 12%.

(4) Anti-Offset Properties:

To evaluate anti-offset properties, a sample image with an image area percentage of about 5% was printed on 10 sheets of A4-size paper, using a laser beam printer LASER JET 1300, manufactured by Hewlett-Packard Co., and in a low-temperature and low-humidity environment (15° C./10% RH), and thereafter sheets of A4-size paper were fed, where the level of contamination on images was evaluated according to the following evaluation criteria. As test paper, copying machine plain paper (64 g/m$^2$ in basis weight) was used.

A: No offset occurs.

B: Offset is seen to have slightly occurred, when watched carefully.

C: Offset has occurred, but to a level it does not look to be worried about.

D: Offset has clearly occurred.

TABLES 8-1 and 8-2

TABLE 1

| | Type of wax | Type of polar group | Melting point (° C.) | Number-average molecular weight (Mn) |
|---|---|---|---|---|
| Wax W-1 | Fischer-Tropsh wax | — | 105 | 780 |
| Wax W-2* | Alcohol modified paraffin wax | Hydroxyl group, carboxyl group | 75 | 510 |
| Wax W-3 | Polyethylene wax | — | 116 | 500 |
| Wax W-4 | Polypropylene wax | — | 150 | 1,010 |
| Wax W-5 | Paraffin wax | — | 78 | 380 |
| Wax W-6* | Maleic anhydride modified polypropylene wax | Carboxyl group | 130 | 990 |
| Wax W-7 | Polyethylene wax | — | 88 | 280 |
| Wax W-8 | Paraffin wax | — | 66 | 510 |
| Wax W-9 | Paraffin wax | — | 53 | 360 |

*Wax W-2: hydroxyl value: 66 mg · KOH/g; acid value: 9 mg · KOH/g

*Wax W-6: acid value: 3.5 mg · KOH/g

TABLE 2

| | Formulation | | | | | Physical properties | | |
|---|---|---|---|---|---|---|---|---|
| High = molecular weight component: | Styrene (pbw) | n-Butyl acrylate (pbw) | Methacrylic acid (pbw) | Monobutyl maleate (pbw) | Polymerization* initiator (pbw) | Glass Main-peak molecular weight | transition temp. (° C.) | Acid value (mg · KOH/g) |
| A-1 | 76.0 | 22.0 | 2.0 | — | 0.7 | 300,000 | 60 | 15 |
| A-2 | 70.0 | 25.0 | — | 5.0 | 0.1 | 1,000,000 | 60 | 8 |
| A-3 | 78.0 | 21.6 | 0.4 | — | 0.8 | 250,000 | 60 | 3 |

*As the polymerization initiator, 2,2-bis(4,4-di-t-butylperoxycyclohexyl)propane was used in all cases.

TABLE 3

| | Formulation | | | | | Physical properties | | |
|---|---|---|---|---|---|---|---|---|
| Low = molecular weight component: | Styrene (pbw) | n-Butyl acrylate (pbw) | Methacrylic acid (pbw) | Wax (pbw) | Polymerization* initiator (pbw) | Main-peak molecular weight | Glass transition temp. (° C.) | Acid value (mg · KOH/g) |
| B-1 | 79.1 | 20.0 | 0.9 | — | 1.4 | 15,000 | 61 | 7 |
| B-2 | 79.1 | 20.0 | 0.9 | W-1 (3) | 1.4 | 15,000 | 61 | 7 |
| B-3 | 80.0 | 19.5 | 0.5 | — | 4.5 | 9,000 | 59 | 3 |
| B-4 | 79.1 | 20.0 | 0.9 | W-4 (3)<br>W-7 (3) | 1.4 | 15,000 | 61 | 7 |

*As the polymerization initiator, di-tert-butyl peroxide was used in all cases.

TABLE 4

| | Formulation | | | | Physical properties | |
|---|---|---|---|---|---|---|
| Cross-linkable resin component: | Styrene (pbw) | n-Butyl acrylate (pbw) | Glycidyl methacrylate (pbw) | Polymerization* initiator (pbw) | Weight-average molecular weight Mw | Epoxy value (eq/kg) |
| C-1 | 79.2 | 19.8 | 1.0 | 5.0 | 8,000 | 0.1 |
| C-2 | 72.0 | 18.0 | 10.0 | 5.0 | 7,000 | 1.1 |

*As the polymerization initiator, di-tert-butyl peroxide was used in all cases.

TABLE 5

| Raw resin: | High = molecular weight component | Low = molecular weight component | Wax | High/low/wax mixing ratio (solid matter ratio) | Analytical values: Weight = average molecular weight | Number = average molecular weight | Main = peak molecular weight | Glass transition temp. (° C.) | Acid value (mg · KOH/g) |
|---|---|---|---|---|---|---|---|---|---|
| R-1 | A-1 | B-1 | W-1 | 30/70/3 | 153,000 | 6,100 | 15,000 | 60 | 9.4 |
| R-2 | A-1 | B-1 | W-3 | 30/70/3 | 151,000 | 6,300 | 15,000 | 61 | 9.3 |
| R-3 | A-1 | B-1 | W-4 | 30/70/3 | 148,000 | 6,100 | 14,800 | 60 | 9.4 |
| R-4 | A-1 | B-1 | W-5 | 30/70/3 | 155,000 | 6,200 | 14,900 | 60 | 9.3 |
| R-5 | A-1 | B-1 | W-6 | 30/70/3 | 152,000 | 6,100 | 14,900 | 60 | 9.4 |
| R-6 | A-2 | B-1 | W-1 | 30/70/3 | 1,600,000 | 33,000 | 15,000 | 61 | 7.3 |
| R-7 | A-1 | B-2 | — | 30/73/— | 147,000 | 5,900 | 13,900 | 59 | 9.5 |
| R-8 | A-1 | B-1 | — | 30/70/— | 150,000 | 6,100 | 15,100 | 61 | 9.4 |
| R-9 | A-3 | B-3 | W-1 | 20/80/3 | 71,000 | 4,500 | 10,000 | 60 | 3.6 |
| R-10 | A-1 | B-4 | — | 30/76/— | 130,000 | 4,800 | 14,700 | 60 | 9.8 |

TABLE 6

| Toner resin: | (A) Raw resin | (B) Cross-linkable resin component | Mixing ratio (A)/(B) | Analytical values: Weight = average molecular weight | Number = average molecular weight | Main = peak molecular weight | Glass transition temp. (° C.) | Acid value (mg · KOH/g) | THF-insoluble matter (wt. %) |
|---|---|---|---|---|---|---|---|---|---|
| M-1 | R-1 | C-1 | 90/10 | 90,000 | 6,000 | 15,000 | 60 | 8.3 | 11 |
| M-2 | R-2 | C-1 | 90/10 | 89,000 | 6,300 | 15,000 | 61 | 8.2 | 11 |
| M-3 | R-3 | C-1 | 90/10 | 90,000 | 6,100 | 14,800 | 60 | 8.4 | 11 |
| M-4 | R-4 | C-1 | 90/10 | 91,000 | 6,200 | 14,900 | 60 | 8.2 | 11 |
| M-5 | R-5 | C-1 | 90/10 | 91,000 | 6,100 | 14,900 | 60 | 8.3 | 11 |
| M-6 | R-6 | C-2 | 90/10 | 700,000 | 25,000 | 15,000 | 61 | 5.9 | 16 |
| M-7 | R-7 | C-1 | 90/10 | 92,000 | 5,900 | 13,900 | 59 | 8.1 | 11 |
| M-8 | R-8 | C-1 | 90/10 (+Wax W1, 3 pbw) | 90,000 | 6,100 | 15,100 | 61 | 8.0 | 11 |
| M-9 | R-9 | C-1 | 90/10 | 71,000 | 4,500 | 10,000 | 60 | 2.4 | 8.9 |
| M-10 | R-10 | C-1 | 90/10 | 82,000 | 5,300 | 14,700 | 60 | 8.0 | 10 |
| M-11 | R-8 | C-1 | 90/10 | 91,000 | 6,100 | 15,100 | 60 | 8.4 | 10 |
| M-12 | R-11 | C-1 | 90/10 | 200,000 | 8,000 | 20,000 | 60 | 14.5 | 10 |

TABLE 7

| | Toner resin | First wax No. | First wax Step | Second wax No. | Second wax Step | T1-T2 (° C.) | Analytical values: Weight = average molecular weight | Number = average molecular weight | Main = peak molecular weight | Glass transition temp. (° C.) | Acid value (mg · KOH/g) |
|---|---|---|---|---|---|---|---|---|---|---|---|
| Toner 1 | M-1 | W-1 | B | W-2 | D | 30 | 101,000 | 7,500 | 15,000 | 60 | 8.3 |
| Toner 2 | M-2 | W-3 | B | W-2 | D | 41 | 117,000 | 8,000 | 15,100 | 61 | 8.4 |
| Toner 3 | M-3 | W-4 | B | W-2 | D | 75 | 108,000 | 7,700 | 14,800 | 60 | 8.1 |
| Toner 4 | M-4 | W-5 | B | W-2 | D | 3 | 115,000 | 8,000 | 14,900 | 60 | 8.2 |
| Toner 5 | M-5 | W-6 | B | W-2 | D | 55 | 116,000 | 8,000 | 14,900 | 60 | 8.3 |
| Toner 6 | M-1 | W-1 | B&D | W-2 | D | 30 | 100,000 | 7,800 | 15,000 | 60 | 8.3 |
| Toner 7 | M-1 | W-1 | B | W-5 | D | 27 | 113,000 | 8,100 | 15,000 | 60 | 8.2 |
| Toner 8 | M-1 | W-1 | B | W-7 | D | 17 | 124,000 | 7,900 | 15,000 | 60 | 8.3 |
| Toner 9 | M-1 | W-1 | B | W-1 | D | 0 | 111,000 | 7,900 | 14,900 | 60 | 8.4 |
| Toner 10 | M-1 | W-1 | B | W-8 | D | 39 | 111,000 | 8,700 | 15,000 | 60 | 8.1 |
| Toner 11 | M-1 | W-1 | B | W-9 | D | 52 | 117,000 | 7,400 | 15,000 | 60 | 8.0 |
| Toner 12 | M-6 | W-1 | B | W-2 | D | 30 | 680,000 | 24,000 | 15,000 | 61 | 5.7 |
| Toner 13 | M-7 | W-1 | A | W-2 | D | 30 | 124,000 | 6,900 | 13,800 | 59 | 8.1 |
| Toner 14 | M-8 | W-1 | C | W-2 | D | 30 | 116,000 | 7,700 | 15,100 | 61 | 8.0 |
| Toner 15 | M-9 | W-1 | B | W-7 | D | 17 | 100,000 | 6,800 | 10,000 | 60 | 2.3 |
| Toner 16 | M-12 | W-1 | *1 | W-2 | D | 30 | 190,000 | 8,000 | 20,000 | 60 | 14.5 |
| Toner 17 | M-10 | W-4 | A | W-7 | A | 62 | 91,000 | 6,000 | 14,600 | 61 | 8.0 |
| Toner 18 | M-11 | W-4 | D | W-7 | D | 62 | 110,000 | 8,100 | 15,100 | 60 | 8.3 |

*1: The resin component was polymerized in xylene, and thereafter the wax was dissolved in the solution.

TABLE 8-1

| | | Evaluation Results | | | | | | | | | | | |
|---|---|---|---|---|---|---|---|---|---|---|---|---|---|
| | | Image density | | | | | | | | | | | |
| | | High temp./high humidity | | | | Normal temp./normal humidity | | | | Low temp./low humidity | | | |
| | | Initial stage | 4k | 8k | 12k | Initial stage | 4k | 8k | 12k | Initial stage | 4k | 8k | 12k |
| Example: | | | | | | | | | | | | | |
| 1 | Toner 1 | 1.42 | 1.41 | 1.40 | 1.40 | 1.44 | 1.43 | 1.44 | 1.43 | 1.45 | 1.46 | 1.43 | 1.42 |
| 2 | Toner 2 | 1.41 | 1.38 | 1.37 | 1.37 | 1.43 | 1.43 | 1.42 | 1.40 | 1.44 | 1.43 | 1.41 | 1.41 |
| 3 | Toner 3 | 1.39 | 1.37 | 1.37 | 1.36 | 1.40 | 1.41 | 1.39 | 1.39 | 1.42 | 1.42 | 1.40 | 1.39 |
| 4 | Toner 4 | 1.33 | 1.31 | 1.30 | 1.30 | 1.39 | 1.38 | 1.37 | 1.36 | 1.40 | 1.40 | 1.41 | 1.40 |
| 5 | Toner 5 | 1.38 | 1.39 | 1.38 | 1.37 | 1.40 | 1.36 | 1.37 | 1.37 | 1.41 | 1.40 | 1.40 | 1.39 |
| 6 | Toner 6 | 1.37 | 1.35 | 1.34 | 1.35 | 1.40 | 1.39 | 1.36 | 1.36 | 1.41 | 1.39 | 1.38 | 1.39 |
| 7 | Toner 7 | 1.39 | 1.39 | 1.38 | 1.39 | 1.40 | 1.39 | 1.39 | 1.38 | 1.44 | 1.41 | 1.40 | 1.39 |
| 8 | Toner 8 | 1.33 | 1.31 | 1.31 | 1.31 | 1.36 | 1.36 | 1.35 | 1.35 | 1.39 | 1.38 | 1.38 | 1.37 |
| 9 | Toner 9 | 1.38 | 1.37 | 1.36 | 1.33 | 1.37 | 1.38 | 1.36 | 1.37 | 1.36 | 1.37 | 1.38 | 1.38 |
| 10 | Toner 10 | 1.31 | 1.30 | 1.30 | 1.29 | 1.33 | 1.33 | 1.34 | 1.32 | 1.38 | 1.37 | 1.36 | 1.33 |
| 11 | Toner 11 | 1.31 | 1.29 | 1.28 | 1.29 | 1.32 | 1.30 | 1.33 | 1.30 | 1.37 | 1.36 | 1.35 | 1.30 |
| 12 | Toner 12 | 1.39 | 1.38 | 1.37 | 1.36 | 1.39 | 1.39 | 1.39 | 1.39 | 1.36 | 1.38 | 1.40 | 1.39 |
| 13 | Toner 13 | 1.35 | 1.33 | 1.33 | 1.30 | 1.38 | 1.36 | 1.33 | 1.33 | 1.39 | 1.38 | 1.38 | 1.39 |
| 14 | Toner 14 | 1.33 | 1.32 | 1.33 | 1.31 | 1.38 | 1.38 | 1.37 | 1.36 | 1.39 | 1.38 | 1.39 | 1.38 |
| 15 | Toner 15 | 1.33 | 1.33 | 1.32 | 1.31 | 1.37 | 1.38 | 1.33 | 1.35 | 1.39 | 1.39 | 1.37 | 1.35 |
| 16 | Toner 16 | 1.35 | 1.31 | 1.29 | 1.29 | 1.37 | 1.33 | 1.30 | 1.30 | 1.40 | 1.33 | 1.31 | 1.31 |
| Comparative Example: | | | | | | | | | | | | | |
| 1 | Toner 17 | 1.29 | 1.28 | 1.23 | 1.21 | 1.33 | 1.32 | 1.30 | 1.29 | 1.35 | 1.34 | 1.33 | 1.32 |
| 2 | Toner 18 | 1.25 | 1.25 | 1.22 | 1.22 | 1.35 | 1.36 | 1.37 | 1.38 | 1.36 | 1.35 | 1.33 | 1.31 |

k: ×1,000 sheets

TABLE 8-2

| | | Evaluation Results | | | | | | | | |
|---|---|---|---|---|---|---|---|---|---|---|
| | | Fog (Low temp./low humidity) | | | | | | | | |
| | | Initial stage | 4k | 8k | 12k | Sleeve melt adhesion 4k | 8k | 12k | Fixing performance | Anti-offset properties |
| Example: | | | | | | | | | | |
| 1 | Toner 1 | 1.1 | 1.2 | 1.3 | 1.1 | A | A | A | A | A |
| 2 | Toner 2 | 2.3 | 2.5 | 2.3 | 2.6 | A | A | A | A | A |
| 3 | Toner 3 | 2.5 | 2.7 | 2.9 | 3.0 | A | A | B | B | A |
| 4 | Toner 4 | 2.1 | 2.2 | 2.5 | 2.3 | A | A | C | A | B |
| 5 | Toner 5 | 2.1 | 2.2 | 2.3 | 2.4 | A | B | C | B | A |
| 6 | Toner 6 | 2.5 | 2.6 | 2.5 | 2.4 | B | B | C | A | B |
| 7 | Toner 7 | 2.8 | 2.5 | 2.6 | 2.5 | A | A | B | A | A |
| 8 | Toner 8 | 3.1 | 3.1 | 3.3 | 3.6 | A | B | C | C | A |
| 9 | Toner 9 | 2.2 | 2.3 | 2.1 | 2.0 | A | C | C | C | A |
| 10 | Toner 10 | 3.1 | 3.0 | 2.6 | 2.8 | B | C | C | A | B |
| 11 | Toner 11 | 3.0 | 2.6 | 2.3 | 3.1 | B | C | C | A | C |
| 12 | Toner 12 | 2.1 | 2.6 | 2.7 | 2.2 | A | A | B | C | A |
| 13 | Toner 13 | 2.0 | 2.1 | 2.8 | 2.6 | A | B | C | B | B |
| 14 | Toner 14 | 3.5 | 3.6 | 3.5 | 4.0 | B | C | C | B | C |
| 15 | Toner 15 | 2.2 | 2.2 | 2.4 | 2.4 | B | C | C | A | C |
| 16 | Toner 16 | 2.2 | 2.5 | 2.3 | 2.6 | B | B | B | B | B |
| Comparative Example: | | | | | | | | | | |
| 1 | Toner 17 | 3.6 | 3.8 | 3.7 | 3.3 | C | D | D | D | D |
| 2 | Toner 18 | 4.1 | 4.5 | 5.1 | 5.3 | D | D | D | E | C |

k: ×1,000 sheets

This application claims priority from Japanese Patent Application No. 2004-043955 filed Feb. 20, 2004, which is hereby incorporated by reference herein.

What is claimed is:

1. A process for producing a toner, which comprises:

subjecting a polymer and a resin component containing a cross-linkable polymer capable of cross-linkingly reacting with the polymer, to cross-linking reaction in the presence of a first wax to form a wax-containing cross-linked polymer composition;

mixing the wax-containing cross-linked polymer composition with at least a colorant and a second wax, followed by melt-kneading to form a toner composition; and pulverizing the toner composition to produce toner particles, wherein the melting point T1 (° C.) of said first wax and the melting point T2 (° C.) of said second wax as measured with a differential scanning calorimeter DSC satisfy the following expression:

$$10 \leqq |T1-T2| \leqq 50.$$

2. The process for producing a toner according to claim 1, wherein at least one of said first wax and said second wax has a polar group.

3. The process for producing a toner according to claim 1, wherein said wax-containing cross-linked polymer composition contains a vinyl resin which contains in the molecule a partial structure represented by the following formula (A):

(A)

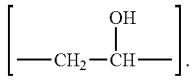

4. The process for producing a toner according to claim 1, wherein a partial structure represented by the following formula (A) is formed during the cross-linking reaction of said polymer with said cross-linkable polymer:

(A)

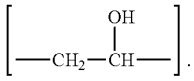

5. The process for producing a toner according to claim 1, wherein said polymer is a vinyl resin having a carboxyl group, said cross-linkable polymer is a vinyl resin having an epoxy group, and the cross-linking reaction takes place between the carboxyl group and the epoxy group.

* * * * *

UNITED STATES PATENT AND TRADEMARK OFFICE

CERTIFICATE OF CORRECTION

PATENT NO. : 7,306,889 B2
APPLICATION NO. : 11/013535
DATED : December 11, 2007
INVENTOR(S) : Nobuyuki Okubo et al.

It is certified that error appears in the above-identified patent and that said Letters Patent is hereby corrected as shown below:

COLUMN 26

Line 9, "B-13.0" should read --B-1 3.0--.

Signed and Sealed this

Eighth Day of July, 2008

JON W. DUDAS
*Director of the United States Patent and Trademark Office*